US011130341B2

(12) United States Patent
Nakai et al.

(10) Patent No.: US 11,130,341 B2
(45) Date of Patent: Sep. 28, 2021

(54) LIQUID EJECTION APPARATUS AND MAINTENANCE APPARATUS

(71) Applicant: CANON KABUSHIKI KAISHA, Tokyo (JP)

(72) Inventors: Hiroshi Nakai, Sagamihara (JP); Noriko Sato, Kawasaki (JP); Takahiro Kiuchi, Fuchu (JP); Yoshinori Yamaguchi, Yokohama (JP); Yuki Amauchi, Kawasaki (JP); Takashi Sasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/528,832

(22) Filed: Aug. 1, 2019

(65) Prior Publication Data

US 2020/0047507 A1 Feb. 13, 2020

(30) Foreign Application Priority Data

Aug. 10, 2018 (JP) ..... JP2018-151443

(51) Int. Cl.
*B41J 2/165* (2006.01)

(52) U.S. Cl.
CPC ..... *B41J 2/16535* (2013.01); *B41J 2/16505* (2013.01)

(58) Field of Classification Search
CPC ..... B41J 2/175; B41J 29/13; B41J 2/16585; B41J 2/1752; B41J 2/17553; B41J 2/1721; B41J 2/17509; B41J 29/02; B41J 29/17; B41J 2/18; B41J 2/16535; B41J 2/16517; B41J 2/16505; B41J 2/145; B41J 2/17513; B41J 2/2114
See application file for complete search history.

(56) References Cited

U.S. PATENT DOCUMENTS 5,969,731 A * 10/1999 Michael ..... B41J 2/16535 347/33
6,578,949 B2 * 6/2003 Takahashi ..... B41J 2/16547 347/23
7,140,716 B2 * 11/2006 Jensen ..... B41J 2/16535 347/33
8,491,085 B2 * 7/2013 Asano ..... B41J 2/16508 347/22
10,479,088 B2 11/2019 Sasaki et al.
2002/0180826 A1 12/2002 Yamaguchi et al.
(Continued)

FOREIGN PATENT DOCUMENTS

JP 2012106430 A 6/2012

OTHER PUBLICATIONS

Copending, unpublished, U.S. Appl. No. 16/564,512 to Takahiro Kiuchi, et al., filed Sep. 9, 2019.

*Primary Examiner* — Thinh H Nguyen
(74) *Attorney, Agent, or Firm* — Venable LLP

(57) ABSTRACT

Provided are a liquid ejection apparatus and a maintenance apparatus capable of suppressing unintended movement of a wiping unit. The maintenance apparatus includes: a wiping unit configured to wipe the ejection opening surface of a liquid ejection head in which ejection openings over a length corresponding to the width of a print medium are formed; and a lock member configured to restrict movement of the wiping unit from a position to which the wiping unit is evacuated from the ejection opening surface.

18 Claims, 15 Drawing Sheets

(56) References Cited

U.S. PATENT DOCUMENTS

| | | | | |
|---|---|---|---|---|
| 2005/0052513 | A1* | 3/2005 | Inoue | B41J 2/175 347/89 |
| 2012/0299996 | A1* | 11/2012 | Kano | B41J 2/16544 347/33 |
| 2014/0198154 | A1 | 7/2014 | O'Hara et al. | |
| 2018/0236773 | A1* | 8/2018 | Hirata | B41J 2/16544 |
| 2018/0311960 | A1 | 11/2018 | Nakai et al. | |
| 2018/0311961 | A1 | 11/2018 | Kiuchi et al. | |
| 2019/0009522 | A1 | 1/2019 | Fukasawa et al. | |
| 2019/0009548 | A1 | 1/2019 | Sato et al. | |
| 2019/0009553 | A1 | 1/2019 | Nakai et al. | |
| 2019/0070855 | A1 | 3/2019 | Yamaguchi et al. | |
| 2019/0291438 | A1 | 9/2019 | Sasaki et al. | |

* cited by examiner

LIQUID EJECTION APPARATUS AND MAINTENANCE APPARATUS

BACKGROUND OF THE INVENTION

Field of the Invention

The present invention relates to a liquid ejection apparatus and a maintenance apparatus that maintain and restore the liquid ejection performance of a liquid ejection head.

Description of the Related Art

The specification of U.S. Patent Laid-Open No. 2014/0198154 discloses a maintenance mechanism including a web wiper that moves in a direction crossing the direction of extension of an ink ejection opening surface from which ink is ejected. In such a maintenance mechanism, the wiper is configured to be moved in the above direction to a position at which the wiper is capable of wiping the ejection opening surface and to an evacuation position at which the wiper is out of contact with the ejection opening surface.

However, with the technique disclosed in the specification of U.S. Patent Laid-Open No. 2014/0198154, in a case where the apparatus receives an impact or is tilted with the wiper located at the evacuation position, the wiper may possibly move and come into contact with the ejection opening surface and damage the ejection opening surface.

SUMMARY OF THE INVENTION

The present invention has been made in view of the above problem, and an object thereof is to provide a liquid ejection apparatus and a maintenance apparatus capable of suppressing unintended movement of a wiper.

In the first aspect of the present invention, there is provided a liquid ejection apparatus including:

a liquid ejection head having an ejection opening surface in which an ejection opening for ejecting a liquid is arranged;

a wiping unit configured to be movable to a wiping position at which the wiping unit is capable of wiping the ejection opening surface and to an evacuation position to which the wiping unit is evacuated from the ejection opening surface; and a lock member configured to restrict movement of the wiping unit from the evacuation position to the wiping position.

In the second aspect of the present invention, there is provided a maintenance apparatus including:

a wiping unit configured to be movable to a wiping position at which the wiping unit is capable of wiping an ejection opening surface of a liquid ejection head and to an evacuation position to which the wiping unit is evacuated from the ejection opening surface, the ejection opening surface being a surface in which an ejection opening for ejecting a liquid is arranged; and a lock member configured to restrict movement of the wiping unit from the evacuation position to the wiping position.

According to the present invention, it is possible to suppress unintended movement of a wiping unit (wiper).

Further features of the present invention will become apparent from the following description of exemplary embodiments with reference to the attached drawings.

DESCRIPTION OF THE EMBODIMENTS

An embodiment of the present invention will be described below with reference to the drawings. It should be noted that the following embodiment does not limit the present invention and that not all of the combinations of the characteristics described in the present embodiment are necessarily essential for solving the problem to be solved by the present invention. Incidentally, relative positions, shapes, and the like of the constituent elements described in the embodiment are exemplary only and are not intended to limit the scope of the invention. In the following embodiment, an inkjet printing apparatus will be exemplarily described as a liquid ejection apparatus including a liquid ejection head that ejects liquid droplets.

Figure 1:
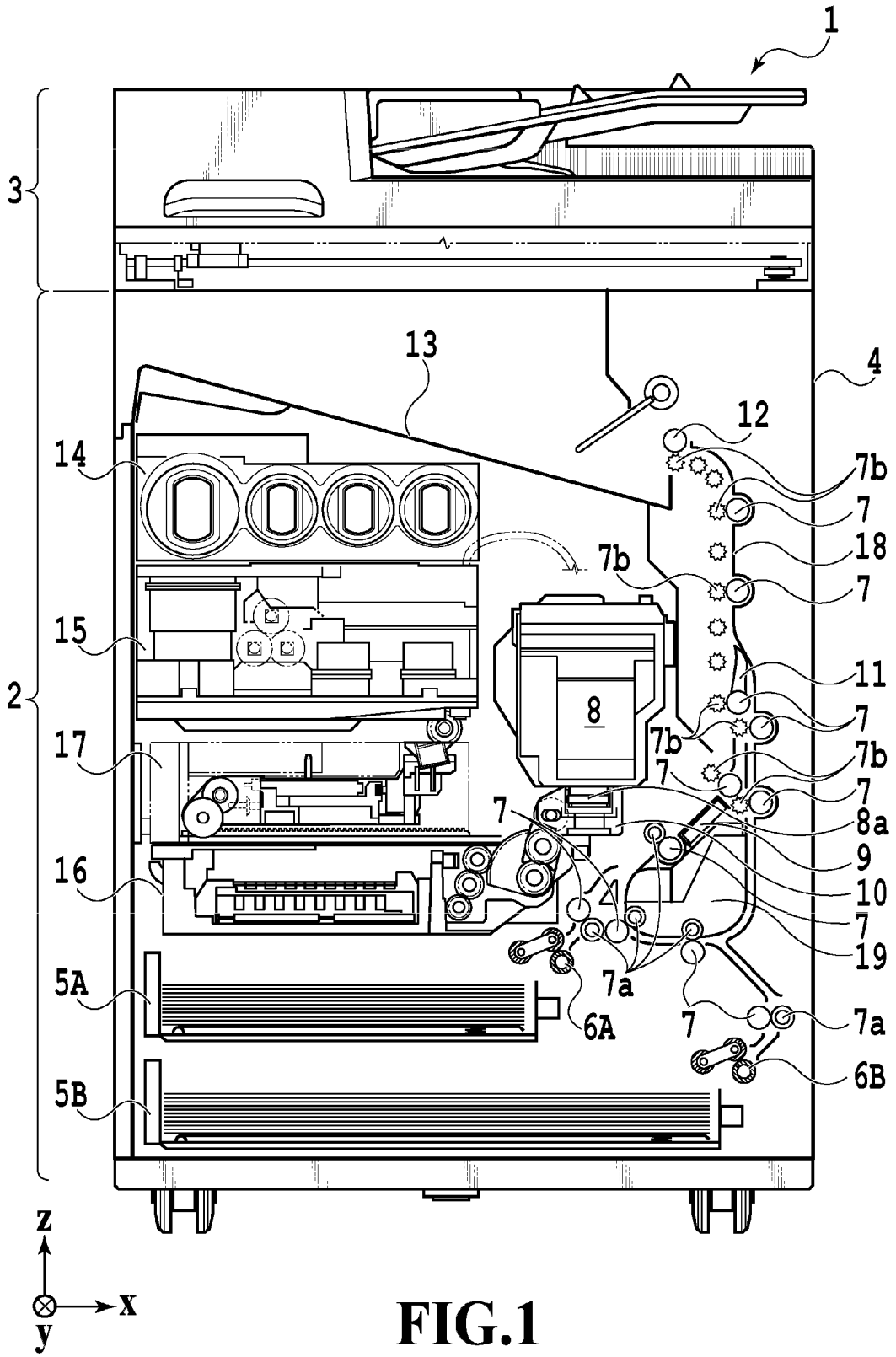
FIG. 1 is a view of a printing apparatus in a standby state.

FIG. 1 is a view of the internal configuration of an inkjet printing apparatus 1 (hereinafter, the printing apparatus 1) used in this embodiment. In FIG. 1, an x-direction represents a horizontal direction, a y-direction (direction normal to the sheet surface) represents a direction in which ejection ports are aligned in a later-described print head 8, and a z-direction represents the vertical direction.

The printing apparatus 1 is a multifunction printer including a print unit 2 and a scanner unit 3. The printing apparatus 1 can use the print unit 2 and the scanner unit 3 separately or in synchronization to perform various processes related to print operation and scan operation. The scanner unit 3 includes an automatic document feeder (ADF) and a flatbed scanner (FBS) and is capable of scanning a document automatically fed by the ADF as well as scanning a document placed by a user on a document plate of the FBS. The present embodiment is directed to the multifunction printer including both the print unit 2 and the scanner unit 3, but the scanner unit 3 may be omitted. FIG. 1 shows the printing apparatus 1 in a standby state in which neither print operation nor scan operation is performed.

A first cassette 5A and a second cassette 5B that house print media (cut sheets) S are mounted in an attachable and detachable manner at a bottom portion of the print section 2 on the lower side of a housing 4 in the vertical direction. The first cassette 5A houses relatively small print media of up to a size of A4 in the form of a flat pile. The second cassette 5B houses relatively large print media of a size of up to A3 in the form of a flat pile. Near the first cassette 5A, a first feed unit 6A is provided which separately feeds the housed print media. Likewise, a second feed unit 6B is provided near the second cassette 5B. When a print operation is performed, a print medium S is fed selectively from one of the cassettes.

Conveying rollers 7, a discharge roller 12, pinch rollers 7*a*, spurs 7*b*, a guide 18, an inner guide 19, and a flapper 11 are conveying mechanisms that guide print media S in predetermined directions. The conveying rollers 7 are drive rollers disposed upstream and downstream of the print head 8 and driven by a conveying motor not illustrated. The pinch rollers 7*a* are driven rollers that rotate while nipping a print medium S with the conveying rollers 7. The discharge roller 12 is a drive roller disposed downstream of the conveying rollers 7 and driven by a conveying motor not illustrated. The spurs 7*b* convey a print medium S while holding it between themselves and the conveying rollers 7 disposed downstream of the print head 8 and the discharge roller 12.

The guide 18 is provided along a conveying path for print media S and guides a print medium S in predetermined directions. The inner guide 19 is a member extending in the y-direction and having a curved side surface and guides a print medium S along this side surface. The flapper 11 is a member that switches the direction of conveying of a print medium S in a double-sided print operation. A discharge tray 13 is a tray on which to place and hold print media S discharged by the discharge roller 12 after completing their print operations.

The print head 8 (liquid ejection head) of the present embodiment is a full line type color inkjet print head. In the print head 8, a plurality of ejection openings for ejecting ink (liquid) in accordance with print data are arrayed in the y-direction in FIG. 1 over a length corresponding to the width of a print medium S. Specifically, the print head 8 is configured to eject inks of a plurality of colors. In a case where the print head 8 is at a standby position, an ejection opening surface 8*a* of the print head 8 is oriented vertically downward and capped by a cap unit 10, as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 stores inks of four colors to be supplied to the print head 8. An ink supply unit 15 is provided at a point along a flow channel connecting the ink tank unit 14 and the print head 8 and adjusts the pressure and flow rate of the inks inside the print head 8 within appropriate ranges. This embodiment employs a circulatory ink feed system. The ink supply unit 15 adjusts the pressure of the inks to be supplied to the print head 8 and the flow rate of the inks collected from the print head 8 within appropriate ranges.

A maintenance unit 16 includes the cap unit 10 and a wiping unit 17 and operates them with a predetermined timing to perform a maintenance operation on the print head 8. The maintenance operation will be described later in detail.

Figure 2:
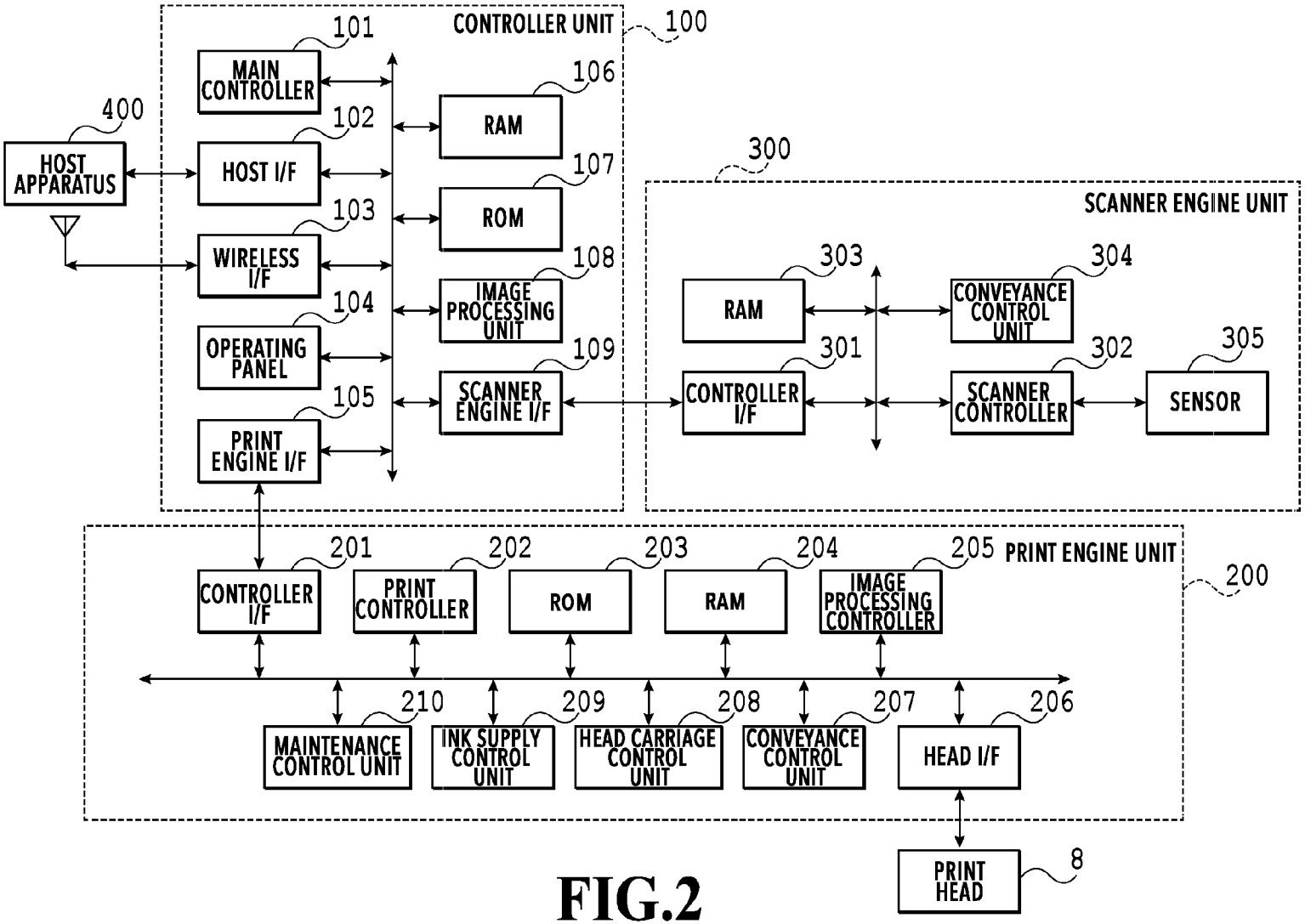
FIG. 2 is a diagram of a control configuration of the printing apparatus.

FIG. 2 is a block diagram illustrating a control configuration in the printing apparatus 1. The control configuration mainly includes a print engine unit 200 that controls the print section 2, a scanner engine unit 300 that controls the scanner section 3, and a controller unit 100 that controls the whole printing apparatus 1. The print controller 202 controls various mechanisms of the print engine unit 200 in accordance with instructions from a main controller 101 of the controller unit 100. Various mechanisms of the scanner engine unit 300 are controlled by the main controller 101 of the controller unit 100. Details of the control configuration will be described below.

In the controller unit 100, the main controller 101, configured of a CPU, controls the entire printing apparatus 1 by using an RAM 106 as a work area in accordance with programs and various parameters stored in an ROM 107. For example, upon input of a print job from a host apparatus 400 through a host I/F 102 or a wireless I/F 103, an image processing unit 108 performs predetermined image processing on received image data in accordance with an instruction from the main controller 101. The main controller 101 then transmits the image data after the image processing to the print engine unit 200 through a print engine I/F 105.

Meanwhile, the printing apparatus 1 may obtain image data from the host apparatus 400 by means of wireless communication or wired communication or from an external storage device (such as a USB memory) connected to the printing apparatus 1. The communication method used for the wireless communication or the wired communication is not particularly limited. For example, Wireless Fidelity (Wi-Fi) (registered trademark) or Bluetooth (registered trademark) can be employed as the communication method used for the wireless communication. Also, universal serial bus (USB) or the like can be employed as the communication method used for the wired communication. Further, for example, upon input of a read command from the host apparatus 400, the main controller 101 transmits this command to the scanner section 3 through a scanner engine I/F 109.

An operation panel 104 is a mechanism with which the user inputs and receives information into and from the printing apparatus 1. Through the operation panel 104, the user can instruct the controller unit 100 to perform operations such as photocopying and scanning, set a print mode, check information on the printing apparatus 1, and so on.

In the print engine unit 200, the print controller 202, configured of a CPU, controls various mechanisms of the print section 2 by using an RAM 204 as a work area in accordance with programs and various parameters stored in an ROM 203. Upon receipt of various commands and image data through a controller I/F 201, the print controller 202 temporarily stores them in an RAM 204. The print controller 202 causes an image processing controller 205 to convert the stored image data into print data so that the print head 8 can use the stored image data in a print operation. After the print data is generated, the print controller 202 causes the print head 8 to perform a print operation based on the print data through a head I/F 206. In doing so, the print controller 202 conveys a print medium S by driving the feed unit 6A or 6B, the conveying rollers 7, the discharge roller 12, and the flapper 11, which are illustrated in FIG. 1, through a conveyance control unit 207. A print process is performed by performing a print operation with the print head 8 in combination with the operation of conveying the print medium S in accordance with instructions from the print controller 202.

A head carriage control unit 208 changes the orientation and position of the print head 8 in accordance with the operation state of the printing apparatus 1 such as a maintenance state or a print state. An ink supply control unit 209 controls the ink supply unit 15 such that the pressure of the inks to be supplied to the print head 8 fall within an appropriate range. A maintenance control unit 210 controls the operation of the cap unit 10 and the wiping unit 17 of the maintenance unit 16 when a maintenance operation is performed on the print head 8.

For the scanner engine unit 300, the main controller 101 controls hardware resources in a scanner controller 302 by using the RAM 106 as a work area in accordance with programs and various parameters stored in the ROM 107. As a result, various mechanisms of the scanner section 3 are controlled. For example, the main controller 101 controls hardware resources in the scanner controller 302 through a controller I/F 301 such that a document loaded on the ADF by the user is conveyed through a conveyance control unit 304 and read by a sensor 305. Then, the scanner controller 302 stores the read image data in an RAM 303. Meanwhile, by converting the image data thus obtained into print data, the print controller 202 can cause the print head 8 to perform a print operation based on the image data read by the scanner controller 302.

Figure 3:
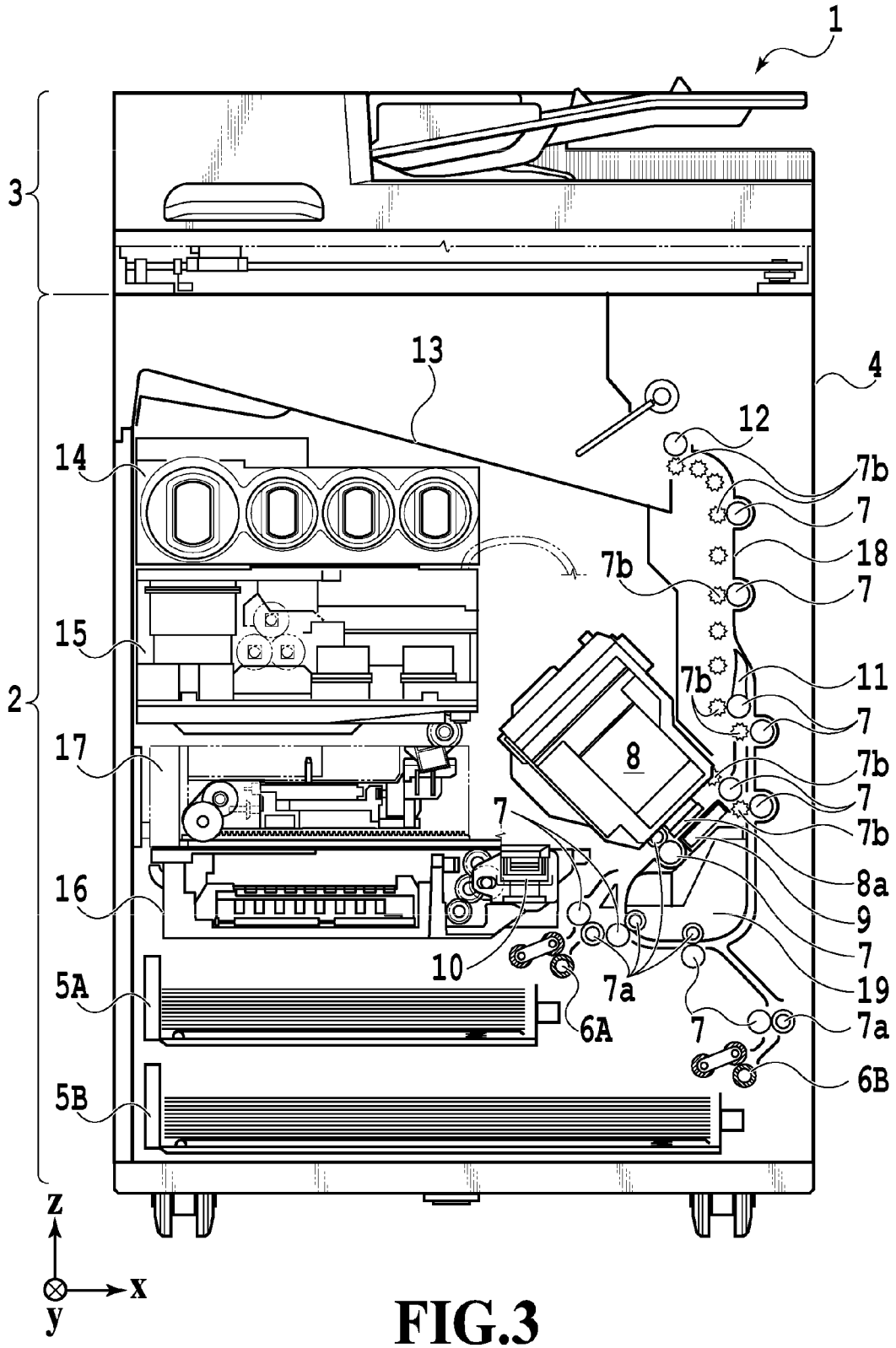
FIG. 3 is a view of the printing apparatus in a print state.

FIG. 3 illustrates the printing apparatus 1 in a print state. In contrast to the standby state illustrated in FIG. 1, the cap unit 10 is separated from the ejection port surface 8*a* of the print head 8, and the ejection port surface 8*a* is facing the platen 9. In this embodiment, the plane of the platen 9 is tilted at approximate 45 degrees with respect to the horizontal direction, and the ejection port surface 8*a* of the print head 8 at the print position is also tilted at approximately 45 degrees with respect to the horizontal direction so that the distance between the ejection port surface 8*a* and the platen 9 can be kept at a fixed distance.

When the print head 8 is moved from the standby position illustrated in FIG. 1 to the print position illustrated in FIG. 3, the print controller 202 lowers the cap unit 10 to a retreat position illustrated in FIG. 3 by using the maintenance control unit 210. As a result, the ejection port surface 8*a* of the print head 8 is separated from a cap member 10*a*. Then, using the head carriage control unit 208, the print controller 202 turns the print head 8 by 45 degrees while adjusting its height level in the vertical direction, to thereby make the ejection port surface 8*a* face the platen 9. The print controller 202 performs the reverse of the above steps when moving the print head 8 from the print position to the standby position after a print operation is completed.

Next, the conveying paths for print media S in the print section 2 will be described. Upon input of a print command, the print controller 202 firstly moves the print head 8 to the print position illustrated in FIG. 3 by using the maintenance control unit 210 and the head carriage control unit 208. The print controller 202 then drives the first feed unit 6A or the second feed unit 6B based on the print command and feeds a print medium S by using the conveyance control unit 207.

Figure 4C:
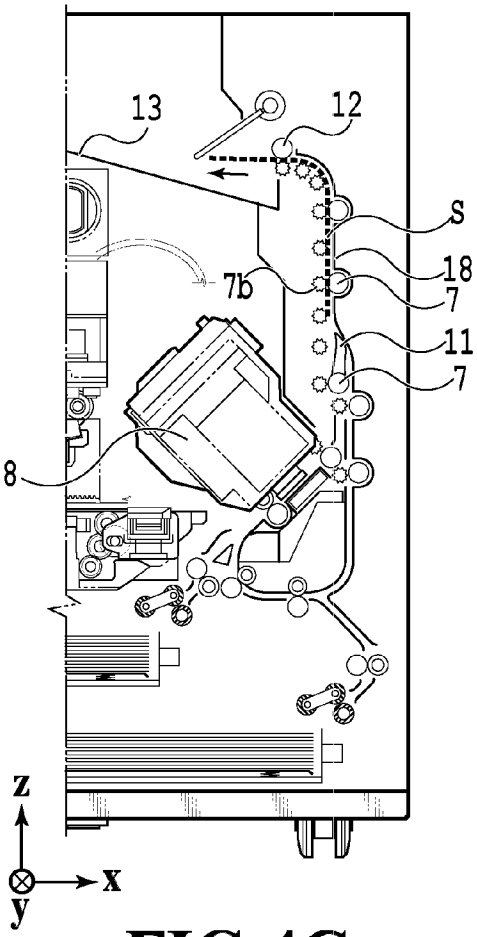
FIG. 4A, FIG. 4B, and FIG. 4C are views of a conveying path of a print medium fed from a first cassette.
Figure 4B:
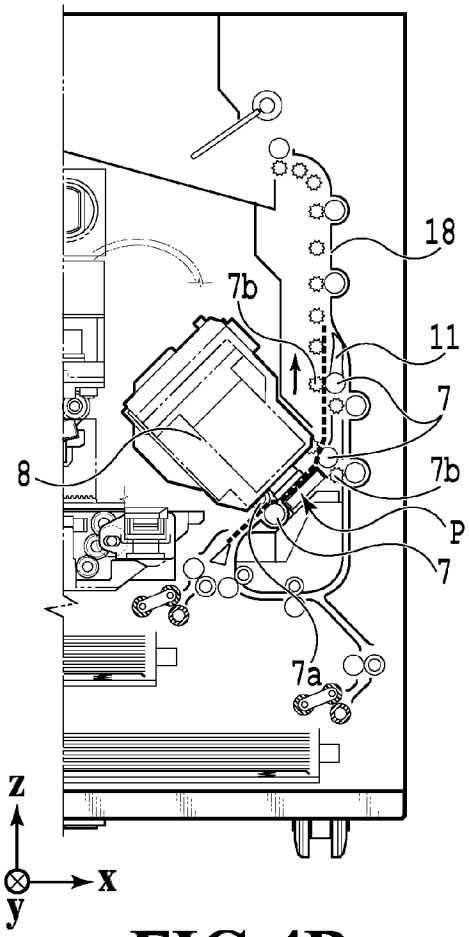
Figure 4A:
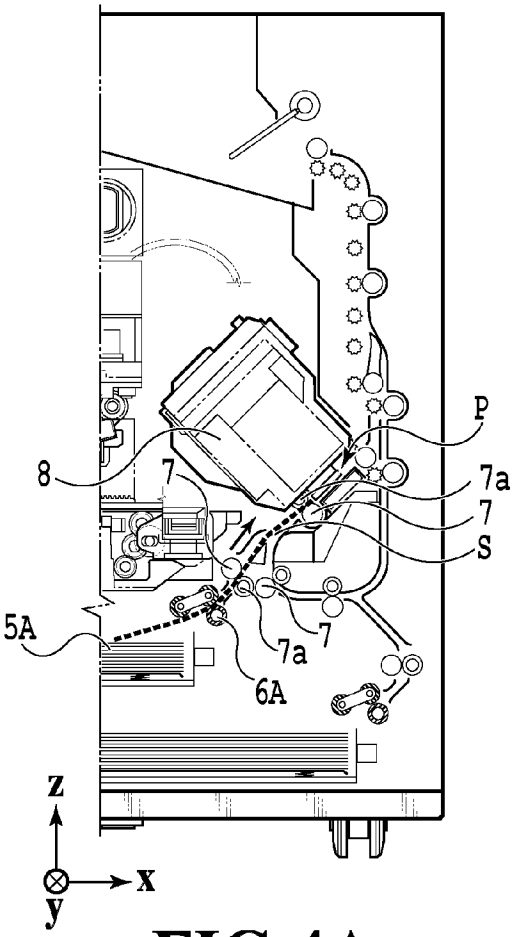

FIG. 4A, FIG. 4B, and FIG. 4C are views illustrating a conveying path used in a case of feeding an A4 print medium S stored in the first cassette 5A. The print medium S stacked at the top in the first cassette 5A is separated from the second and lower print media by the first feed unit 6A and conveyed toward a printing region P between the platen 9 and the print head 8 while being nipped between some conveying rollers 7 and pinch rollers 7*a*. FIG. 4A illustrates a conveying state immediately before the leading edge of the print medium S reaches the printing region P. The direction of travel of the print medium S is changed from the horizontal direction (x-direction) to a direction tilted at approximately 45 degrees with respect to the horizontal direction by the time the print medium S reaches the printing region P after being fed by the first feed unit 6A.

At the printing region P, the inks are ejected toward the print medium S from the plurality of ejection ports provided in the print head 8. The platen 9 supports the back surface of the region of the print medium S to which the inks are to be applied, and the distance between the ejection port surface 8*a* and the print medium S is kept at a fixed distance. After the inks are applied, the print medium S passes the left side of the flapper 11, whose tip is tilted toward the right side, and is conveyed upward in the vertical direction of the printing apparatus 1 along the guide 18 while being guided by some conveying rollers 7 and spurs 7*b*. FIG. 4B illustrates a state where the leading edge of the print medium S has passed the printing region P and is being conveyed upward in the vertical direction. The direction of travel of the print medium S has been changed to the vertically upward direction by the conveying rollers 7 and spurs 7*b* from the position of the printing region P, which is tilted at approximately 45 degrees with respect to the horizontal direction.

After being conveyed vertically upward, the print medium S is discharged onto the discharge tray 13 by the discharge roller 12 and the spur 7*b*. FIG. 4C illustrates a state where the leading edge of the print medium S has passed the discharge roller 12 and is being discharged onto the discharge tray 13. The print medium S after being discharged is held on the discharge tray 13 in a state where its surface on which the image was printed by the print head 8 faces down.

Figure 5C:
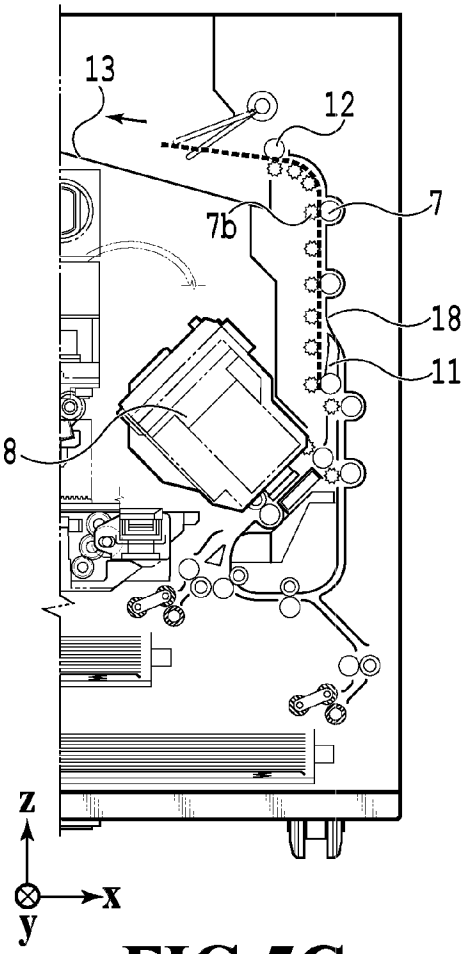
FIG. 5A, FIG. 5B, and FIG. 5C are views of a conveying path of a print medium fed from a second cassette.
Figure 5B:
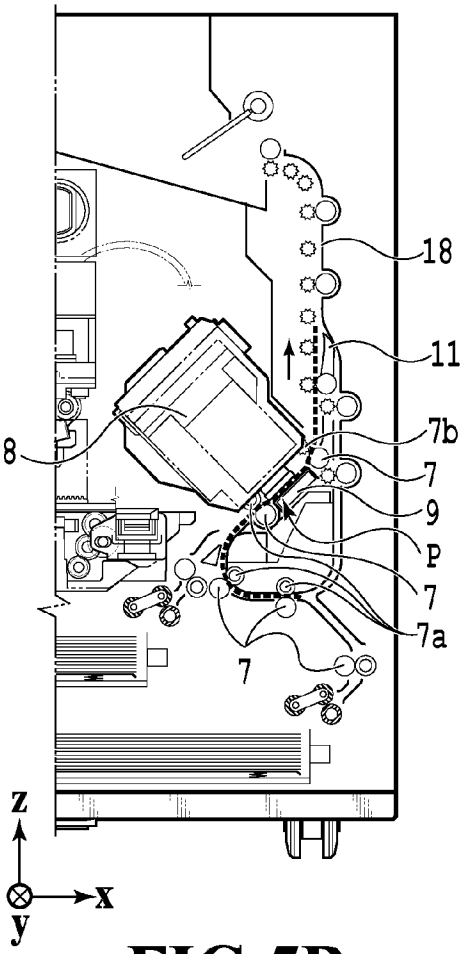
Figure 5A:
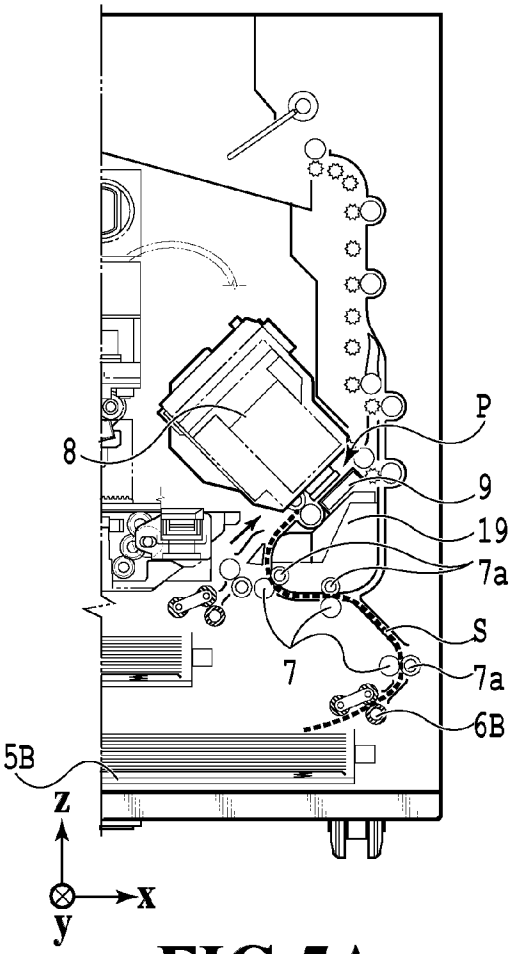

FIG. 5A, FIG. 5B, and FIG. 5C are views illustrating a conveying path used in a case of feeding an A3 print medium S stored in the second cassette 5B. The print medium S stacked at the top in the second cassette 5B is separated from the second and lower print media by the second feed unit 6B and conveyed toward the printing region P between the platen 9 and the print head 8 while being nipped between some conveying rollers 7 and pinch rollers 7*a*.

FIG. 5A illustrates a conveying state immediately before the leading edge of the print medium S reaches the printing region P. Pluralities of conveying rollers 7 and pinch rollers 7*a* and the inner guide 19 are disposed along the conveying path from the point at which the print medium P is fed by the second feed unit 6B to the point at which the print medium P reaches the printing region P. Hence, the print medium P is conveyed to the platen 9 while being curved in an S-shape.

The subsequent part of the conveying path is the same as that in the case with an A4 print medium S illustrated in FIG. 4B and FIG. 4C. FIG. 5B illustrates a state where the leading edge of the print medium S has passed the printing region P and is being conveyed upward in the vertical direction. FIG. 5C illustrates a state where the leading edge of the print medium S has passed the discharge roller 12 and is being discharged onto the discharge tray 13.

FIG. 6A, FIG. 6B, FIG. 6C, and FIG. 6D illustrate a conveying path used in a case of performing a print operation on the back surface (second surface) of an A4 print medium S (double-sided printing). In the case of performing double-sided printing, printing is performed on a first surface (front surface) and thereafter a print operation is performed on a second surface (back surface). The conveying steps for performing the first surface printing are the same as FIG. 4A, FIG. 4B, and FIG. 4C and description thereof will therefore be omitted here. The conveying steps following FIG. 4C will be described below.

Figure 6D:
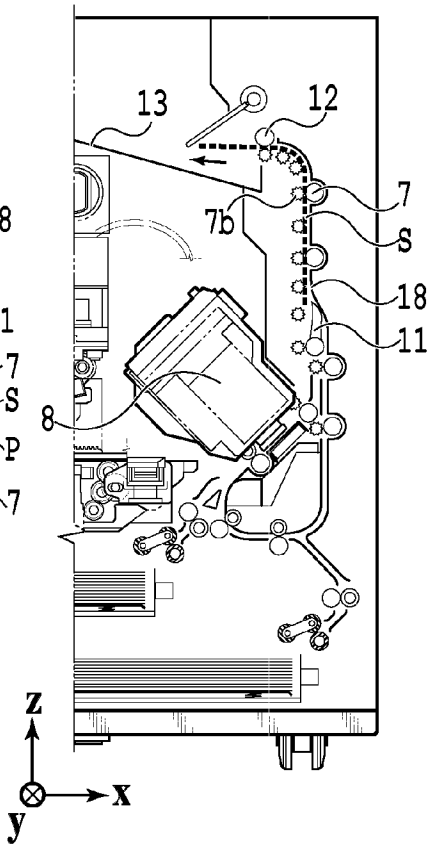
FIG. 6A, FIG. 6B, FIG. 6C, and FIG. 6D are views of views of a conveying path used in a case of performing a print operation on the back surface of a print medium.
Figure 6C:
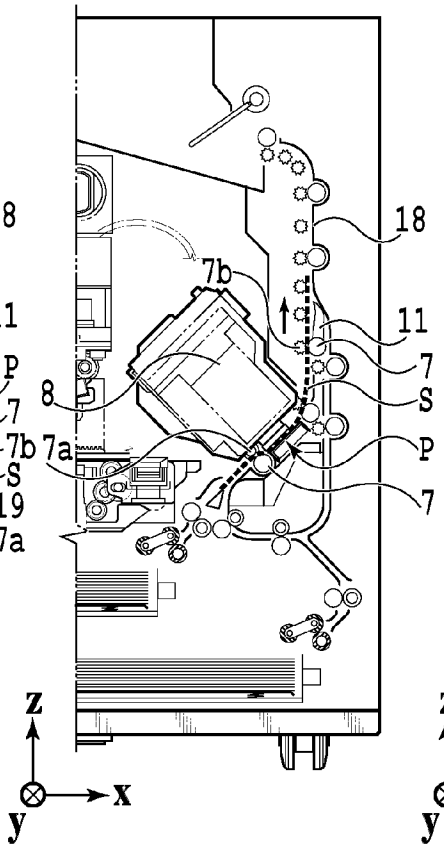
Figure 6B:
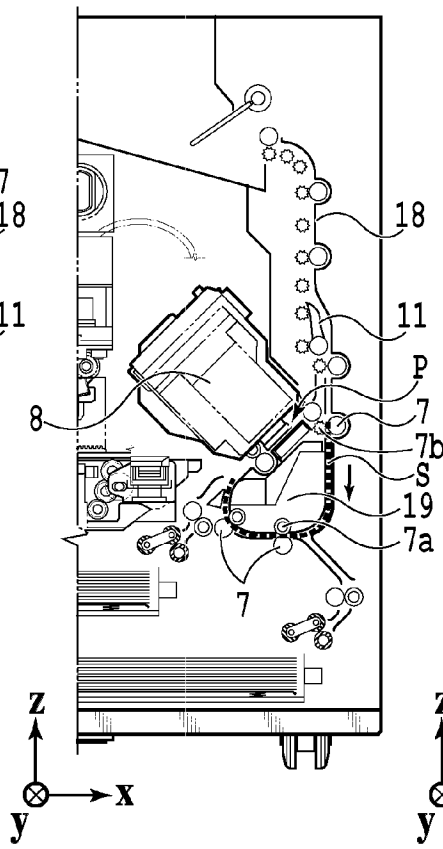
Figure 6A:
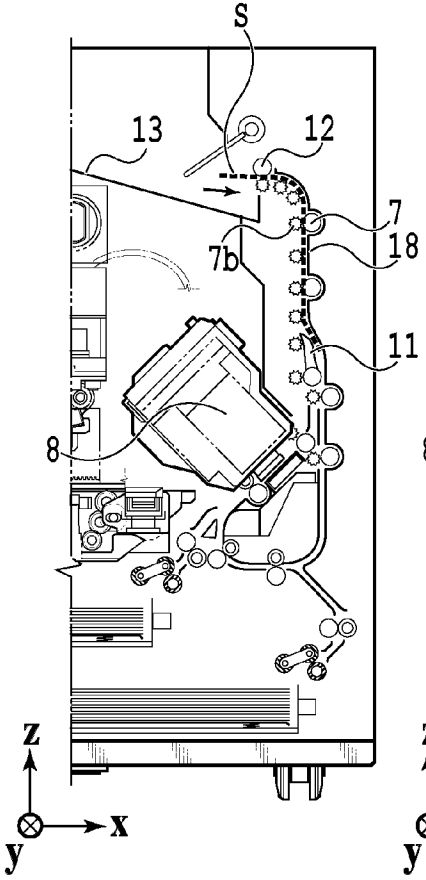

After the print operation on the first surface by the print head 8 is completed and the trailing edge of the print medium S passes the flapper 11, the print controller 202 rotates the conveying rollers 7 in the opposite direction to thereby convey the print medium S to the inner side of the printing apparatus 1. At this moment, the flapper 11 is controlled by an actuator not illustrated such that its tip is tilted toward the left side. Thus, the leading edge of the print medium S (the trailing edge in the print operation on the first surface) passes the right side of the flapper 11 and is conveyed downward in the vertical direction. FIG. 6A illustrates a state where the leading edge of the print medium S (the trailing edge in the print operation on the first surface) is passing the right side of the flapper 11.

Thereafter, the print medium S is conveyed along the curved outer circumferential surface of the inner guide 19 and conveyed to the printing region P between the print head 8 and the platen 9 again. This time, the second surface of the print medium S faces the ejection port surface 8*a* of the print head 8. FIG. 6B illustrates a conveying state immediately before the leading edge of the print medium S reaches the printing region P for the print operation on the second surface.

The subsequent part of the conveying path is the same as that for the first surface printing illustrated in FIG. 4B and FIG. 4C. FIG. 6C illustrates a state where the leading edge of the print medium S has passed the printing region P and is being conveyed upward in the vertical direction. At this moment, the flapper 11 is controlled by the actuator not illustrated to move to the position at which its tip is tilted toward the right side. FIG. 6D illustrates a state where the leading edge of the print medium S has passed the discharge roller 12 and is being discharged onto the discharge tray 13.

Next, the maintenance operation on the print head 8 will be described. As also described with reference to FIG. 1, the maintenance unit 16 in this embodiment includes the cap unit 10 and the wiping unit 17 and operates them with a predetermined timing to perform the maintenance operation.

Figure 7:
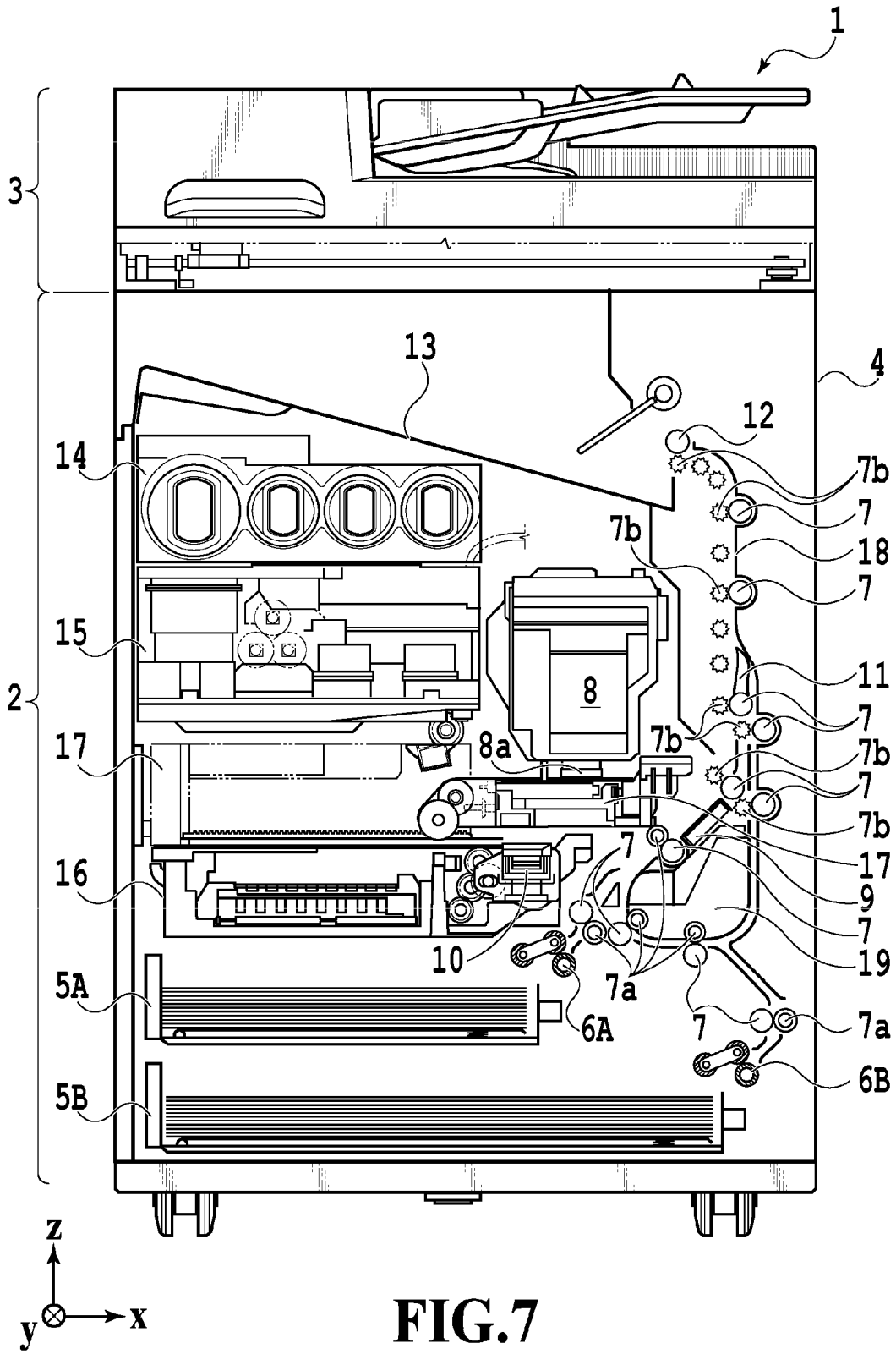
FIG. 7 is a view of the printing apparatus in a maintenance state.

FIG. 7 is a view of the printing apparatus 1 in the maintenance state. To move the print head 8 from the standby position illustrated in FIG. 1 to a maintenance position illustrated in FIG. 7, the print controller 202 moves the print head 8 upward in the vertical direction and moves the cap unit 10 downward in the vertical direction. The print controller 202 then moves the wiping unit 17 in the rightward direction in FIG. 7 from its retreat position. The print controller 202 thereafter moves the print head 8 downward in the vertical direction to thereby move it to the maintenance position, at which the maintenance operation can be performed.

Also, to move the print head 8 from the print position illustrated in FIG. 3 to the maintenance position illustrated in FIG. 7, the print controller 202 moves the print head 8 upward in the vertical direction while turning it by 45 degrees. The print controller 202 then moves the wiping unit 17 in the rightward direction from its retreat position. The print controller 202 thereafter moves the print head 8 downward in the vertical direction to thereby move it to the maintenance position, at which the maintenance operation by the maintenance unit 16 can be performed.

Figure 8A:
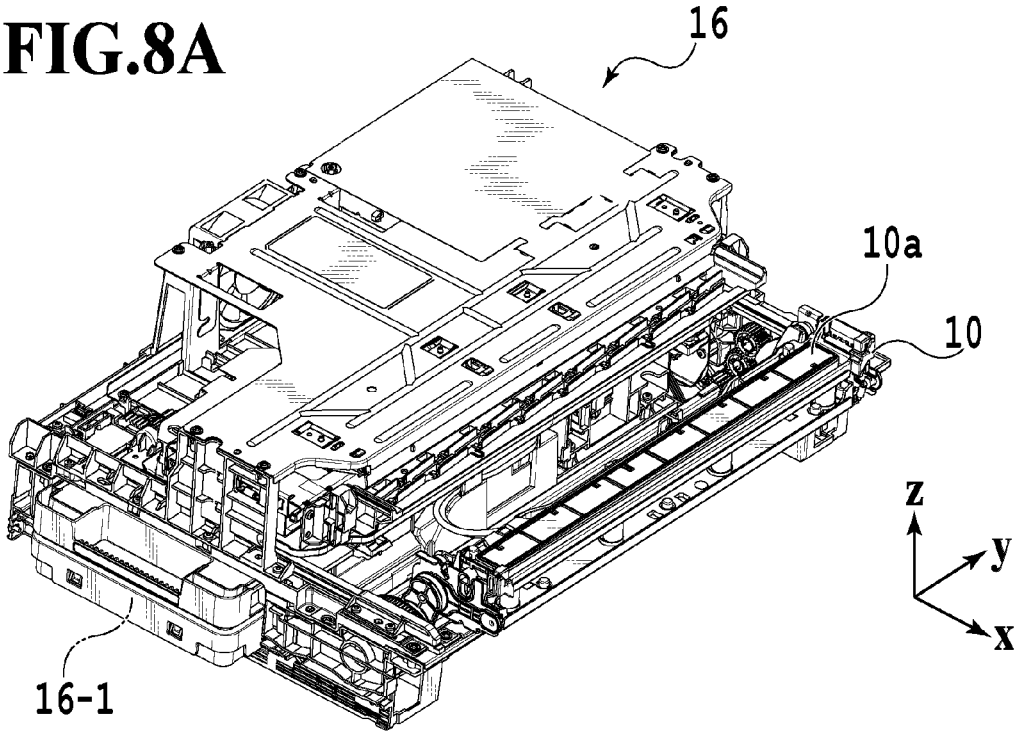
FIG. 8A and FIG. 8B are perspective views illustrating the configuration of a maintenance unit.
Figure 8B:
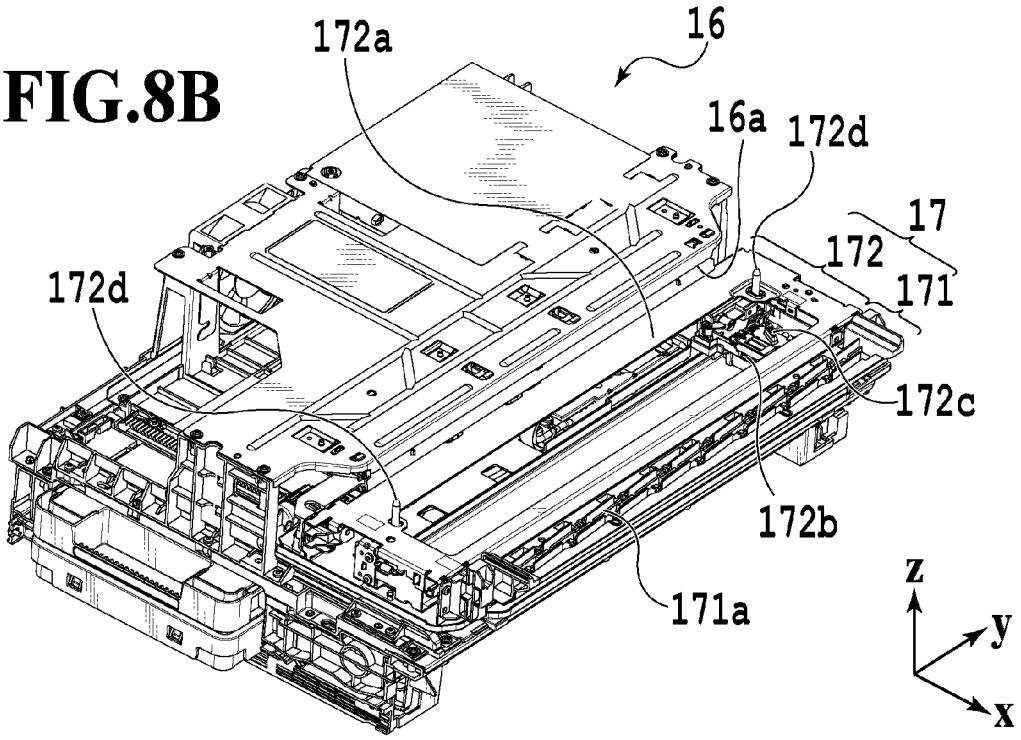

FIG. 8A is a perspective view showing a state where the maintenance unit 16 is in a standby position while FIG. 8B is a perspective view showing a state where the maintenance unit 16 is in a maintenance position. FIG. 8A corresponds to FIG. 1 while FIG. 8B corresponds to FIG. 7. In a case where the print head 8 is at the standby position, the maintenance unit 16 is in the standby position shown in FIG. 8A, the cap unit 10 is moved to an upper side in the vertical direction, and the wiping unit 17 is housed in the maintenance unit 16. Specifically, in the above state, the cap unit 10 is at a cap position (described later), and the wiping unit 17 is at the evacuation position (described later). The cap unit 10 has a box-shaped cap member 10*a* extending in the y-direction. The cap unit 10 is capable of suppressing evaporation of the inks from the ejection openings by bringing this cap member 10*a* into tight contact with the ejection opening surface 8*a* of the print head 8. The cap unit 10 also has a function of collecting the inks ejected onto the cap member 10*a* for preliminary ejection or the like and sucking the collected inks with a suction pump 218 (described later).

On the other hand, in the maintenance position shown in FIG. 8B, the cap unit 10 is moved to a lower side in the vertical direction (below in a direction of gravity) and the wiping unit 17 is pulled out of the maintenance unit 16. Specifically, in the above state, the cap unit 10 is at the evacuation position (described later), and the wiping unit 17 is at a wiping start position (described later) from which the wiping unit 17 can perform wiping. The wiping unit 17 includes two wiper units, namely, a blade wiper unit 171 and a vacuum wiper unit 172.

In the blade wiper unit 171, blade wipers 171*a* that wipe the ejection port surface 8*a* in the x-direction are disposed along the y-direction over a length corresponding to the region along which the ejection ports are aligned. To perform a wiping operation using the blade wiper unit 171, the wiping unit 17 moves the blade wiper unit 171 in the x-direction with the print head 8 positioned at such a height level that the print head 8 can contact the blade wipers 171*a*. With this movement, the blade wipers 171*a* wipe the inks and the like attached to the ejection port surface 8*a*.

At the inlet of the maintenance unit 16 through which the blade wipers 171*a* are housed, a wet wiper cleaner 16*a* is disposed which removes the inks attached to the blade wipers 171*a* and applies a wetting liquid to the blade wipers 171*a*. Each time the blade wipers 171*a* are housed into the maintenance unit 16, the matters attached to the blade wipers 171*a* are removed and the wetting liquid is applied thereto by the wet wiper cleaner 16*a*. Then, the next time the blade wipers 171*a* wipe the ejection port surface 8*a*, the wetting liquid is transferred onto the ejection port surface 8*a*, thereby improving the lubricity between the ejection port surface 8*a* and the blade wipers 171*a*.

On the other hand, the vacuum wiper unit 172 has a flat plate 172*a* with an opening portion extending in the y-direction, a carriage 172*b* capable of moving in the y-direction within the opening portion, and a vacuum wiper 172*c* mounted on the carriage 172*b*. The vacuum wiper 172*c* is disposed so as to be capable of wiping the ejection opening surface 8*a* in the y-direction with movement of the carriage 172*b*. At the tip of the vacuum wiper 172*c*, a suction opening is formed which is connected to the suction pump 218. Thus, by moving the carriage 172*b* in the y-direction with the suction pump 218 actuated, the inks and the like attached to the ejection opening surface 8*a* of the print head 8 are wiped by the vacuum wiper 172*c* and sucked into its suction opening. In this operation, the flat plate 172*a* and positioning pins 172*d* provided at opposite ends of its opening portion are used to position the vacuum wiper 172*c* relative to the ejection opening surface 8*a*.

In this embodiment, it is possible to perform a first wiping process in which the wiping operation by the blade wiper unit 171 is performed but the wiping operation by the vacuum wiper unit 172 is not performed and a second wiping process in which both wiping processes are sequentially performed. To perform the first wiping process, the print controller 202 first pulls the wiping unit 17 out of the maintenance unit 16 with the print head 8 retreated to above the maintenance position in FIG. 7 in the vertical direction. The print controller 202 then moves the print head 8 downward in the vertical direction to such a position that the print head 8 can contact the blade wipers 171*a*, and thereafter moves the wiping unit 17 to the inside of the maintenance unit 16. With this movement, the blade wipers 171*a* wipe the inks and the like attached to the ejection port surface 8*a*. Specifically, the blade wipers 171*a* wipe the ejection port surface 8*a* as they are moved from the position to which the wiping unit 17 has been pulled out of the maintenance unit 16 to the inside of the maintenance unit 16.

After the blade wiper unit 171 is housed, the printer controller 202 moves the cap unit 10 to an upper side in the vertical direction to bring the cap member 10*a* into tight contact with the ejection opening surface 8*a* of the print head 8. The printer controller 202 then drives the print head 8 in this state to cause it to perform preliminary ejection, and sucks the inks collected in the cap member 10*a* with the suction pump 218.

On the other hand, to perform the second wiping process, the printer controller 202 firstly slides the wiping unit 17 to pull it out of the maintenance unit 16 with the print head 8 evacuated to vertically above the maintenance position in FIG. 7. The printer controller 202 then moves the print head 8 vertically downward to such a position that the print head 8 can contact the blade wipers 171*a*, and thereafter moves the wiping unit 17 to the inside of the maintenance unit 16. As a result, the wiping operation by the blade wipers 171*a* is performed on the ejection opening surface 8*a*. Subsequently, the printer controller 202 slides the wiping unit 17 to pull it out of the maintenance unit 16 to a predetermined position with the print head 8 evacuated to vertically above the maintenance position in FIG. 7. The printer controller 202 then positions the ejection opening surface 8*a* and the vacuum wiper unit 172 relative to each other by using the flat plate 172*a* and the positioning pins 172*d* while lowering the print head 8 to the maintenance position shown in FIG. 7. The printer controller 202 thereafter performs the above-described wiping operation by the vacuum wiper unit 172. The printer controller 202 evacuates the print head 8 vertically upward and houses the wiping unit 17, and then performs preliminary ejection into the cap member and the operation of sucking the collected inks with the cap unit 10, as in the first wiping process.

Figure 9A:
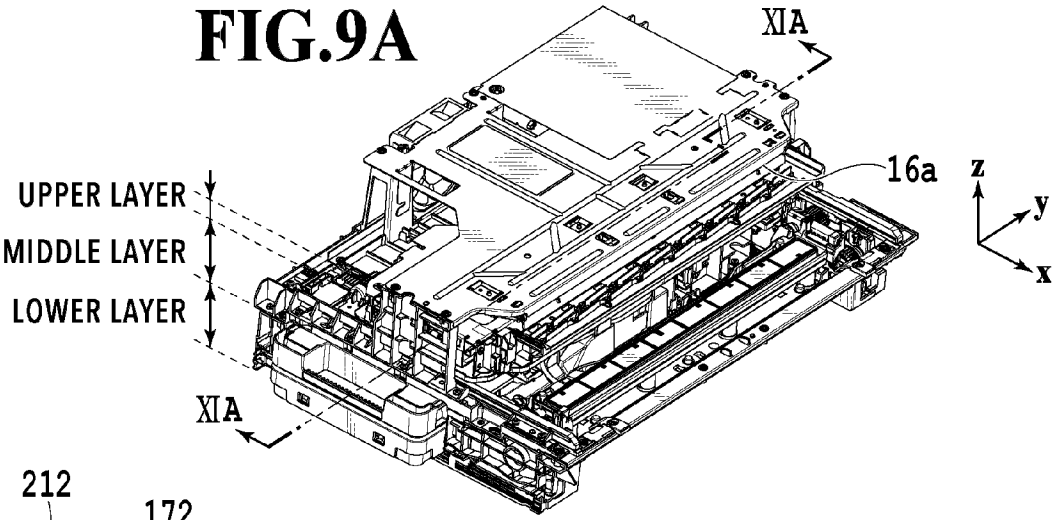
FIGS. 9A, 9B, and 9C are perspective views showing the configuration of each layer in the maintenance unit.
Figure 9C:
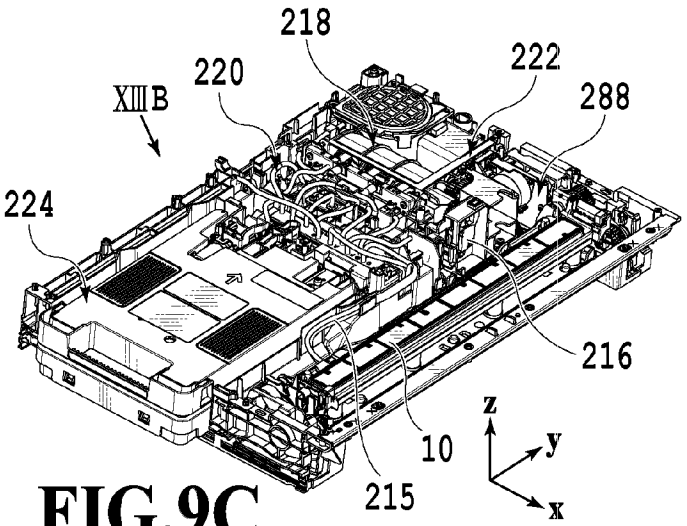
Figure 9B:
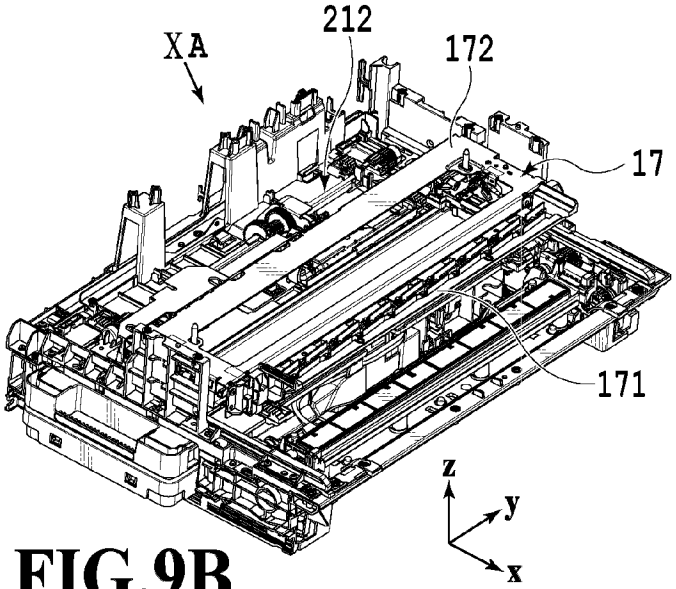

Next, the specific configuration of the maintenance unit 16 (maintenance apparatus) will be described in detail with reference to FIGS. 9A to 15F. FIG. 9A is a schematic perspective view of the maintenance unit 16. FIG. 9B is a view showing a state where an upper layer of the maintenance unit 16 in FIG. 9A is removed to expose a middle layer. FIG. 9C is a view showing a state where the upper layer and the middle layer of the maintenance unit 16 in FIG. 9A are removed to expose a lower layer.

The maintenance unit 16 includes three layers, namely, the upper layer, the middle layer, and the lower layer, stacked in the z-direction. In the upper layer, the wet wiper cleaner 16*a* (process liquid applying unit) is disposed so as to contact the blade wipers 171*a*, arrayed in the y-direction, with movement of the wiping unit 17, located in the middle layer (see FIG. 9A). In the middle layer, there are disposed the wiping unit 17, which is movable in the x-direction, and a first drive part 212 which moves the wiping unit 17 (see FIG. 9B).

In the lower layer, there are disposed the cap unit 10, which protects the ejection opening surface 8*a* of the print head 8, and a fourth drive part 288 which moves the cap unit 10. Also, there are disposed a lock member 216 which fixes the wiping unit 17 at the evacuation position, and the suction pump 218, which is connected to the cap unit 10, the vacuum wiper unit 172, and so on through tubes 215 or the like. Further, there is disposed a valve unit 220 which selectively opens and closes the tubes (flow path) 215, connecting the suction pump 218 to the cap unit 10 and the vacuum wiper unit 172. Furthermore, there are disposed a third drive part 222 which drives the lock member 216, the suction pump 218, and the valve unit 220, and a cartridge 224 which collects waste inks.

In the present embodiment, stationary constituent elements of the maintenance unit 16 are disposed in the layer. This saves space while allowing the wiping unit 17 to have a certain range of movement in the middle layer. Also, the cartridge 224 (storage member), which stores inks collected through a tube, is disposed in the lower layer. Thus, the cartridge 224 is located vertically below the cap position of the cap unit 10 and thus efficiently collects inks.

Figure 10A:
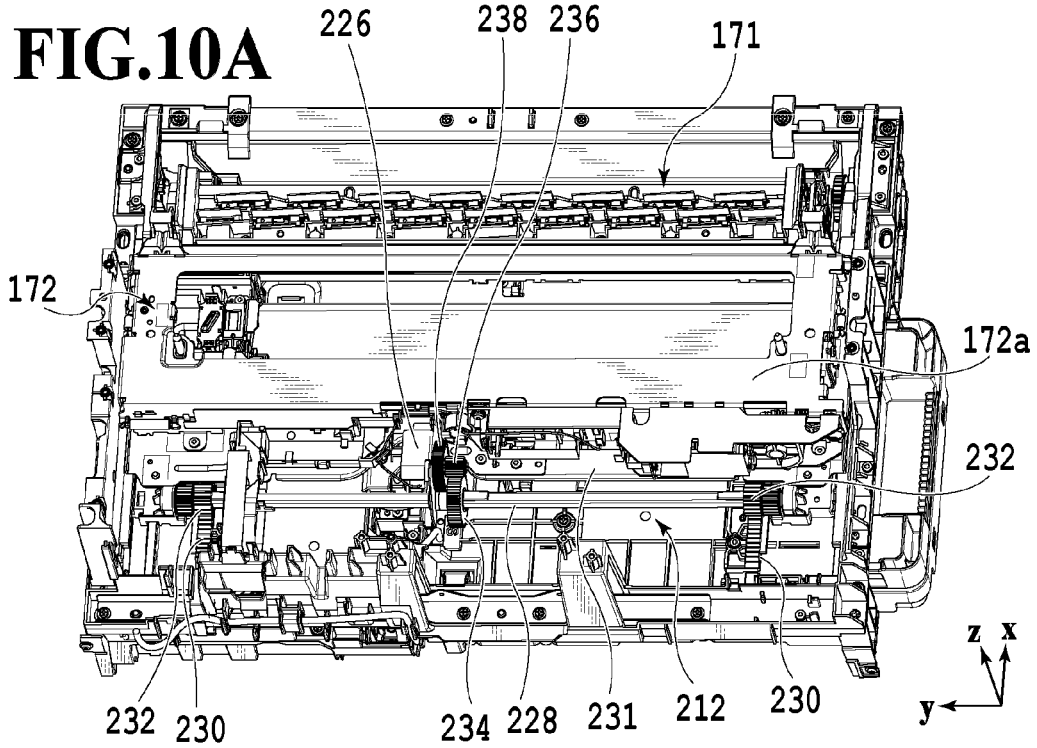
FIGS. 10A and 10B are views explaining a drive system for a wiping unit.
Figure 10B:
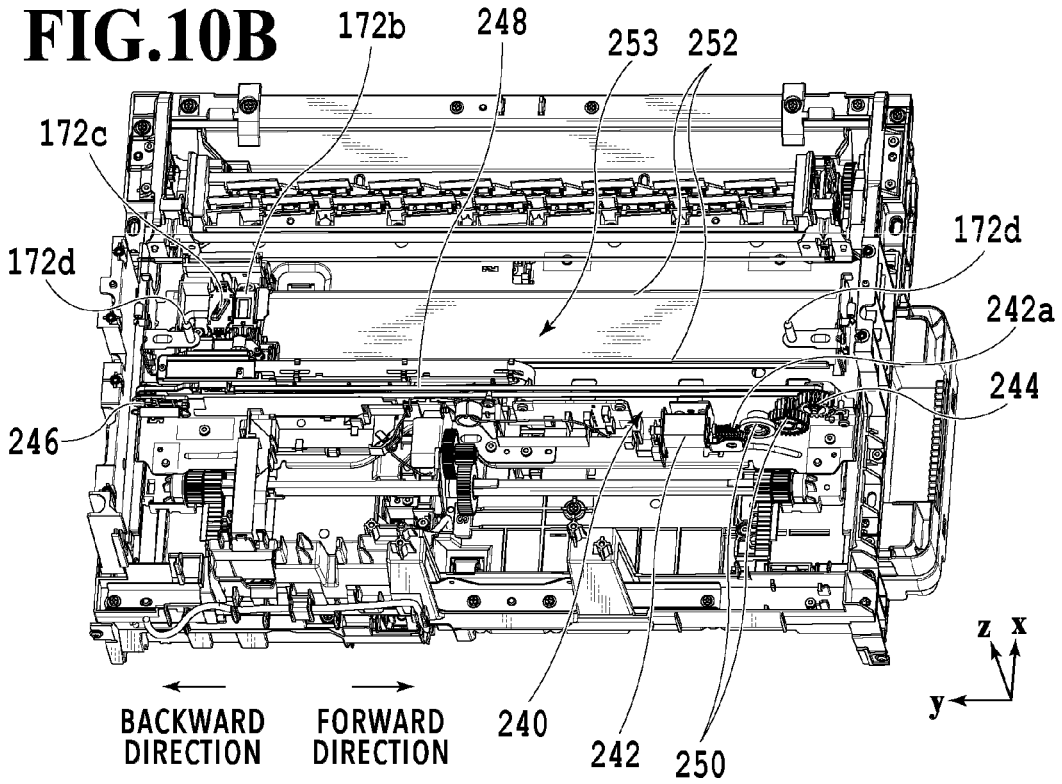

FIG. 10A is a view as seen along arrow XA in FIG. 9B. FIG. 10B is a view showing a state where the flat plate 172*a* in FIG. 10A is detached. The wiping unit 17 (wiping unit), disposed in the middle layer, is moved in the x-direction by the first drive part 212. This movement allows the wiping of the ejection opening surface 8*a* of the print head 8 by the blade wiper unit 171, the application of a wetting liquid (process liquid) to the blade wipers 171*a* by the wet wiper cleaner 16*a*, and so on.

The wiping unit 17 is configured to be moved between the evacuation position and the wiping start position by the first drive unit 212. The evacuation position of the wiping unit 17 is located upstream of the cap unit 10, provided in the lower layer, in the x-direction. The wiping start position of the wiping unit 17 is a position from which the wiping unit 17 can wipe the ejection opening surface 8*a* of the print head 8 at the maintenance position with movement toward the evacuation position. Also, the evacuation position of the wiping unit 17 is a position at which the wiping unit 17 is outside the movement path for the cap unit 10 and out of contact with the print head 8. In the present embodiment, the wiping unit 17 is housed in the maintenance unit 16 in a case where the wiping unit 17 is at the evacuation position. The wiping unit 17 is located at the evacuation position in the case where the maintenance unit 16 is in the standby position, as shown in FIG. 8A. The wiping unit 17 is located at the wiping start position in the case where the maintenance unit 16 is in the maintenance position, as shown in FIG. 8B. Meanwhile, the wiping unit 17 shown in FIG. 10 is located at the evacuation position.

As shown in FIG. 10A, the first drive part 212 includes a first motor 226, a shaft 228 extending in the y-direction, pinions 232 provided at the opposite ends of the shaft 228 and meshing with racks 230 integrally supported on the maintenance unit 16. Note that the first motor 226 is fixed to a bottom plate 231 of the wiping unit 17. Also, the racks 230 extend in the x-direction in proximity to the opposite ends of the wiping unit 17 in the y-direction. A shaft gear 234 is fixed to the shaft 228. A motor gear 238 that is rotated by drive of the first motor 226 is coupled to the shaft gear 234 through an idler gear 236.

Thus, drive force from the first motor 226 is transmitted to the shaft 228 through the motor gear 238, the idler gear 236, and the shaft gear 234 and thereby rotates the shaft 228. The rotation of the shaft 228 moves the wiping unit 17 along the racks 230 from the evacuation position to the wiping start position or vice versa. In the present embodiment, forward rotation of the first motor 226 moves the wiping unit 17 from the evacuation position to the wiping start position, whereas reverse rotation moves the wiping unit 17 from the wiping start position to the evacuation position.

The wiping unit 17 includes the vacuum wiper unit 172. As mentioned above, the vacuum wiper unit 172 includes the carriage 172*b*, movable in the y-direction, and the vacuum wiper 172*c*, disposed on the carriage 172*b*. The carriage 172*b* is configured to be driven by a second drive part 240 provided to the wiping unit 17. The vacuum wiper 172*c* is connected to the suction pump 218 through a tube (not shown), and performs wiping while sucking inks with negative pressure applied from the suction pump 218. Note that this tube is attached to the valve unit 220.

As shown in FIG. 10B, the second drive part 240 includes a second motor 242, a pulley gear 244 that is rotated by drive force from the second motor 242, and a belt 248 stretched between the pulley gear 244 and a tension pulley 246. The second motor 242 is disposed on the wiping unit 17. A motor gear 242*a* that is rotated by the second motor 242 is coupled to the pulley gear 244 through a plurality of idler gears 250. The pulley gear 244 is disposed on one end side in the y-direction while the tension pulley 246 is disposed on the other end side in the y-direction, and the belt 248 is disposed substantially in parallel to the y-direction. Also, the carriage 172*b* is fixed to the belt 248. Note that the carriage 172*b* is disposed slidably on guide rails 252 extending in the y-direction. Hence, the carriage 172*b* is slidable on the guide rails 252 by drive (turn) of the belt 248.

Thus, drive force from the second motor 242 is transmitted to the pulley gear 244 through the idler gears 250 and the like and thereby rotates the pulley gear 244. This rotation of the pulley gear 244 turns the belt 248, so that the carriage 172*b*, fixed to the belt 248, slides in the y-direction. In sum, in the maintenance unit 16, the wiping unit 17, movable in the x-direction, includes the vacuum wiper 172*c*, movable in the y-direction, which crosses the x-direction. In the present embodiment, forward rotation of the second motor 242 moves the carriage 172*b* in a forward direction along the y-direction from the other end side to the one end side, whereas reverse rotation moves the carriage 172*b* in a backward direction along the y-direction from the one end side to the other end side. Note that in the present embodiment, the vacuum wiper unit 172 executes the vacuum wiping while the carriage is moved in the forward direction.

Meanwhile, a guide rail unit 253 which has the guide rails 252 is integrally provided with the positioning pins 172*d* and configured to be slidable by a predetermined distance relative to the bottom plate 231 of the wiping unit 17. The ejection opening surface 8*a* and the vacuum wiper unit 172 are positioned relative to each other by bringing the positioning pin 172*d* into contact with the print head 8 or inserting the positioning pin 172*d* into the print head 8.

Figure 11A:
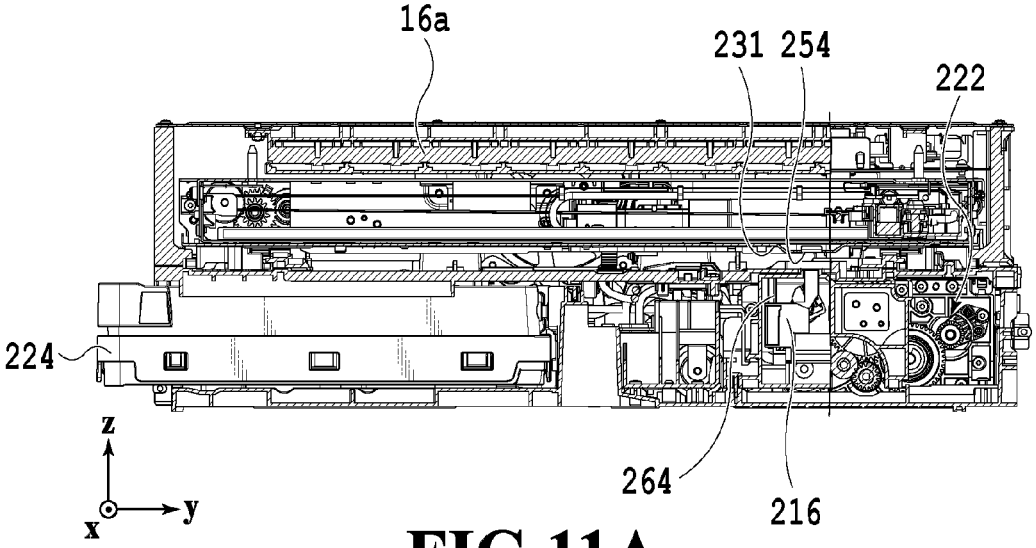
FIGS. 11A and 11B are views explaining a lock member.
Figure 11B:
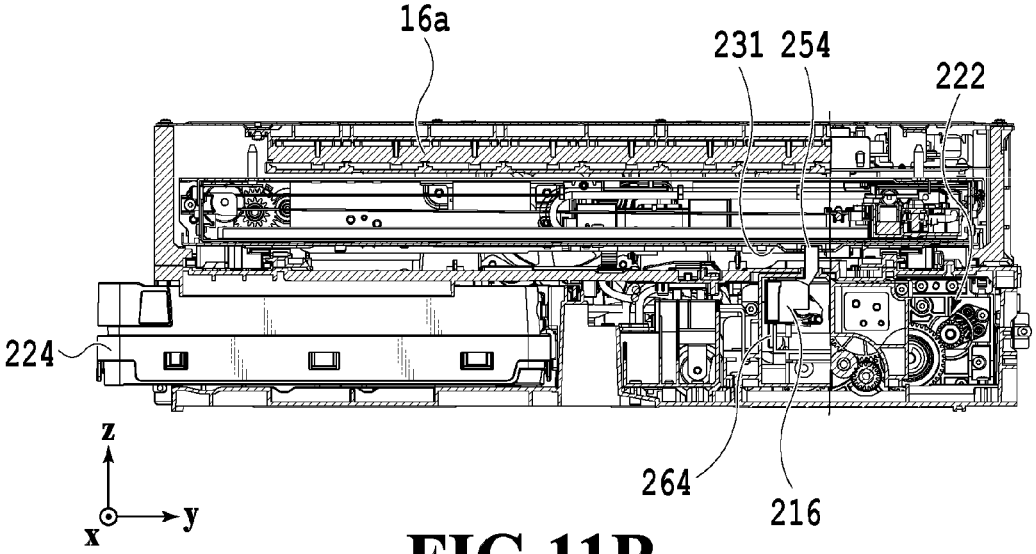
Figure 12A:
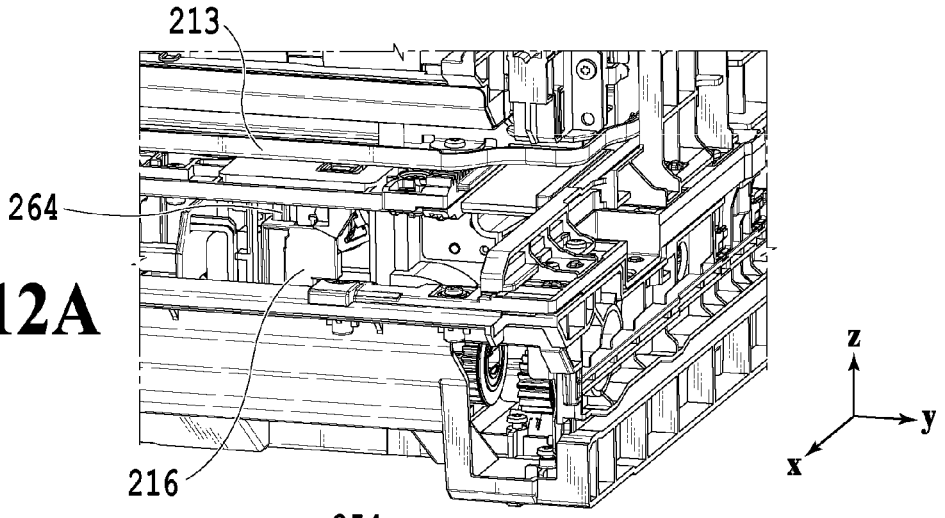
FIGS. 12A, 12B, and 12C are views explaining how the lock member is engaged with the wiping unit.
Figure 12B:
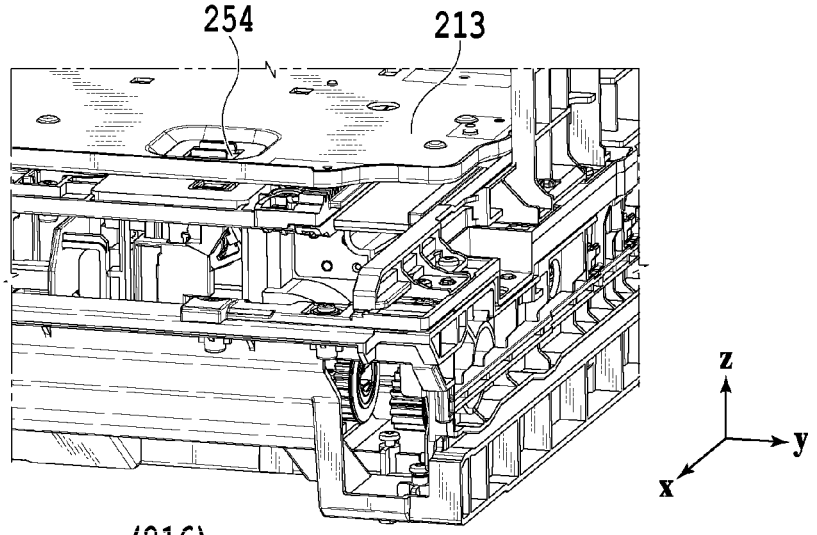
Figure 12C:
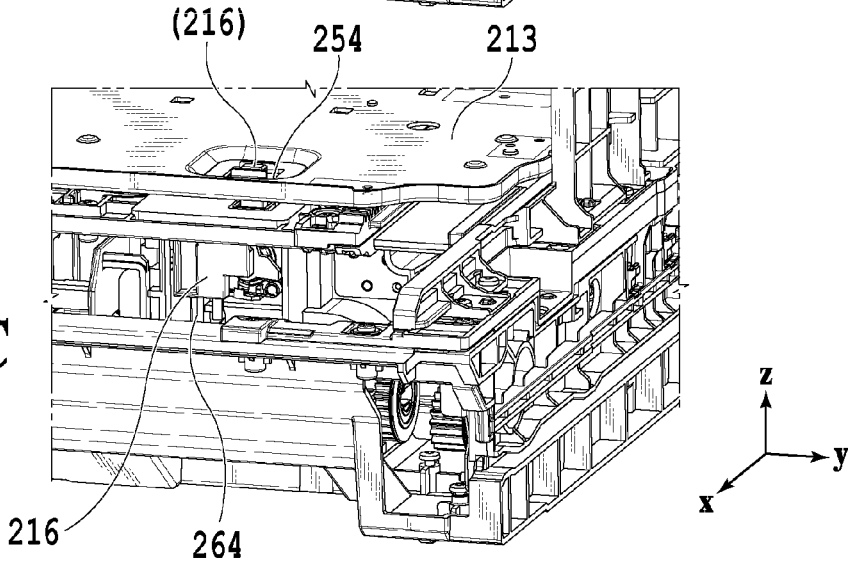

FIGS. 11A and 11B are cross-sectional views along line XIA-XIA in FIG. 9A. FIG. 11A is a view showing an unlocked state of the wiping unit 17 by the lock member 216. FIG. 11B is a view showing a locked state of the wiping unit 17 by the lock member 216. FIGS. 12A, 12B, and 12C are enlarged views of a part around the lock member. FIG. 12A is a view showing the unlocked state by the lock member 216. FIG. 12B is a view showing only the bottom plate 231 for the wiping unit 17 in FIG. 12A. FIG. 12C is a view showing the locked state by the lock member 216.

The lock member 216, disposed in the lower layer, fixes the wiping unit 17, disposed in the middle layer, at the evacuation position. The lock member 216 is configured to be raised and lowered by drive of the third drive part 222. The lock member 216 is raised to lock and fix the wiping unit 17 at the evacuation position (see FIG. 11B), that is, restrict movement of the wiping unit 17. The lock member 216 is lowered to unlock and unfix the wiping unit 17 at the evacuation position (see FIG. 11A), that is, release the restriction on movement of the wiping unit 17 and allow movement. In other words, the lock member 216 is configured to be selectively movable to a position to lock the wiping unit 17 (first position) and a position to unlock the wiping unit 17 (second position).

The bottom plate 231 of the wiping unit 17 is provided with a hole portion 254 which the lock member 216 can be inserted into and pulled out from. As shown in FIGS. 12A to 12C, the hole portion 254 is formed at a position where the lock member 216 can be raised and lowered to be inserted into and pulled out from the hole portion 254 in the case where the wiping unit 17 is at the evacuation position. Thus, inserting the lock member 216 into the hole portion 254 locks the wiping unit 17. On the other hand, pulling out the lock member 216 from the hole portion 254 unlocks the wiping unit 17.

Figure 13A:
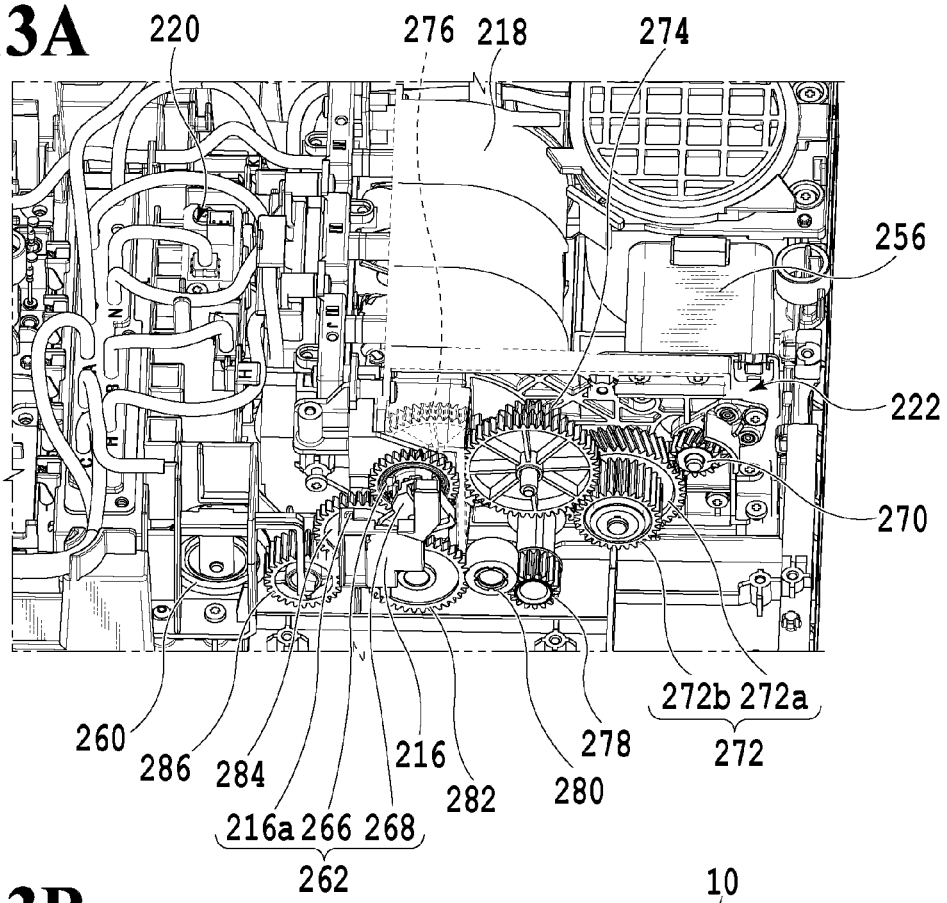
FIGS. 13A and 13B are views explaining drive systems for members disposed in the lower layer.

FIG. 13A is an explanatory view of the drive mechanism of the third drive part 222. The third drive part 222 (drive unit) drives the lock member 216 and also the valve unit 220 and the suction pump 218. As shown in FIG. 13A, the third drive part 222 includes a third motor 256 that generates drive force, and a pump gear 276 that drives the suction pump 218 with drive force from the third motor 256 transmitted to the pump gear 276. The third drive part 222 also includes a valve cam gear 260 that is rotated by drive force from the third motor 256 to drive a valve cam (not shown) which controls the opening-closing operation of the valve unit 220, and a lifting part 262 that raises and lowers the lock member 216 with the drive force.

The lifting part 262 includes the lock member 216, which is supported by a slide part 216*a* (see FIG. 13A) to be slidable relative to a guide member 264 (see FIGS. 11A and 11B) extending in the z-direction. The lifting part 262 also includes a gear member 266 that transmits drive force from the third motor 256 to a drive member 268 (described below). The lifting part 262 further includes the drive member 268, which raises and lowers the lock member 216 with rotation of the gear member 266. The drive member 268 is rotated along with the gear member 266 by a spring member (not shown) that is in pressure contact with and slides on the gear member 266. Here, as the value of torque generated on the spring member exceeds a predetermined value, the gear member 266 slips relative to the drive member 268, so that the drive member 268 is not raised or lowered any farther.

As the drive member 268 moves the lock member 216 to around the upper end of the guide member 264, the value of the torque generated on the spring member exceeds the predetermined value, so that the gear member 266 slips relative to the drive member 268. Note that the lock member 216 is at a height (z-direction) position at which the lock member 216 is inserted in the hole portion 254 in the case where the lock member 216 is located around the upper end of the guide member 264. As the drive member 268 moves the lock member 216 to around the lower end of the guide member 264, the value of the torque generated on the spring member exceeds the predetermined value, so that the gear member 266 slips relative to the drive member 268. In the present embodiment, the configuration is such that forward rotation of the third motor 256 raises the lock member 216 to put the wiping unit 17 into the locked state, whereas reverse rotation lowers the lock member 216 to put the wiping unit 17 into to the unlocked state.

Forward rotation (first drive) of the third motor 256 rotates a motor gear 270, so that a one-way gear 272 meshing with the motor gear 270 is rotated. The one-way gear 272 includes a large gear 272*a* and a small gear 272*b*. The large gear 272*a* is rotated by forward rotation and reverse rotation of the third motor 256 whereas the small gear 272*b* is rotated only by forward rotation of the third motor 256. Thus, upon forward rotation of the third motor 256, drive force is transmitted through an idler gear 274 in mesh with the small gear 272*b* of the one-way gear 272 to the pump gear 276, which is in mesh with the idler gear 274. As a result, the suction pump 218 (suction unit) is driven.

Also, as the large gear 272*a* of the one-way gear 272 is rotated by the forward rotation of the third motor 256, drive force is transmitted to the gear member 266 through idler gears 278, 280, and 282 and the like. This drive force rotates the drive member 268 along with the gear member 266, and the rotation of the drive member 268 raises the lock member 216, thereby putting the wiping unit 17 into the locked state.

Reverse rotation (second drive) of the third motor 256 rotates the large gear 272*a* of the one-way gear 272 through the motor gear 270 but does not rotate the small gear 272*b*, so that the suction pump 218 is not driven. By this rotation of the large gear 272*a*, drive force is transmitted to the valve cam gear 260 through the idler gears 278, 280, 282, 284, and 286. This drive force rotates the valve cam, thereby executing opening-closing operation of the valve unit 220 (switching of the flow path). Note that valve cam gear 260 is a one-way gear. Hence, by forward rotation of the third motor 256, drive force is transmitted to the valve cam gear 260 through the idler gears 278, 280, 282, 284, and 286 but the valve cam gear 260 slips, so that the valve cam is not driven.

Also, by reverse rotation of the third motor 256, drive force is transmitted to the gear member 266 through the large gear 272*a*, the idler gears 278, 280, 282, and the like. This drive force rotates the drive member 268 along with the gear member 266. The direction of this rotation of the gear member 266 and the drive member 268 is opposite from the direction in which they are rotated by forward rotation of the third motor 256. This rotation of the drive member 268 lowers the lock member 216, thereby putting the wiping unit 17 into the unlocked state.

Figure 13B:
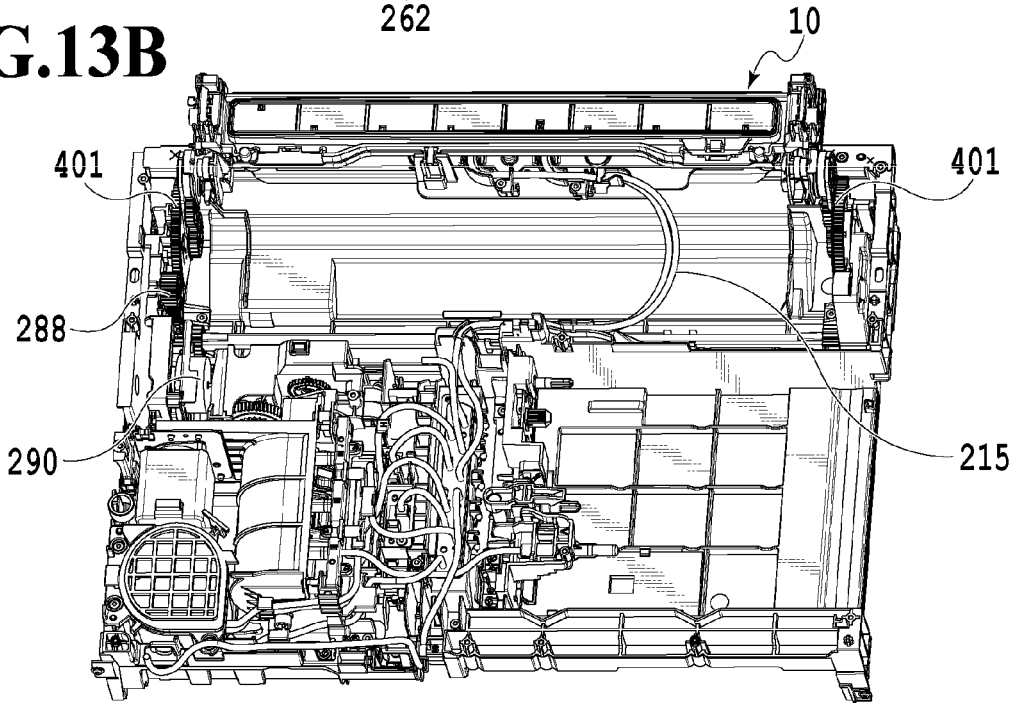
Figure 14A:
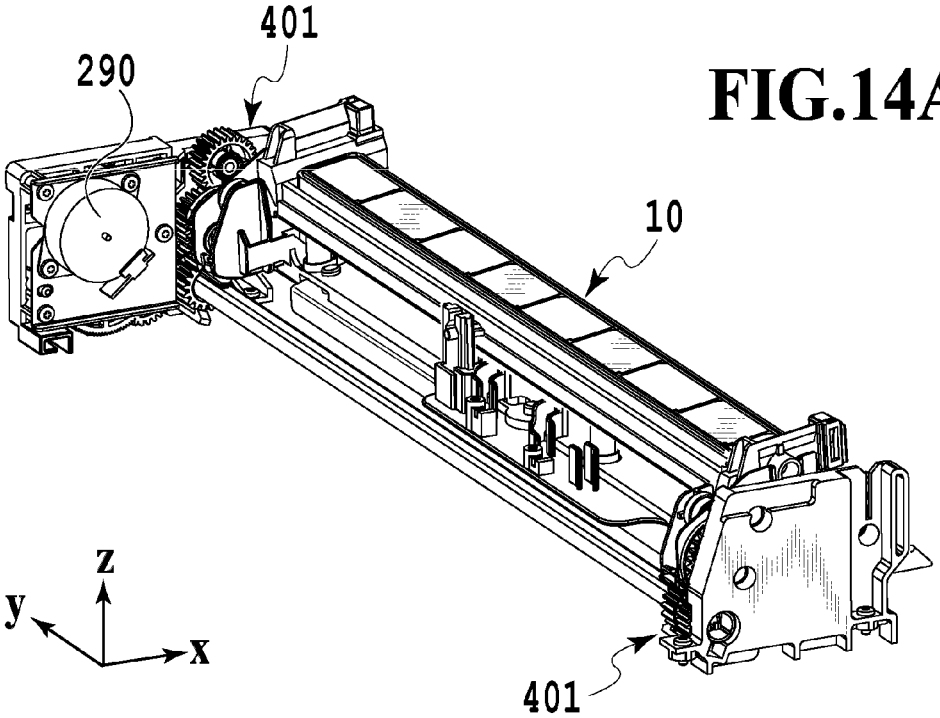
FIGS. 14A and 14B are views explaining a drive system for a cap unit.
Figure 14B:
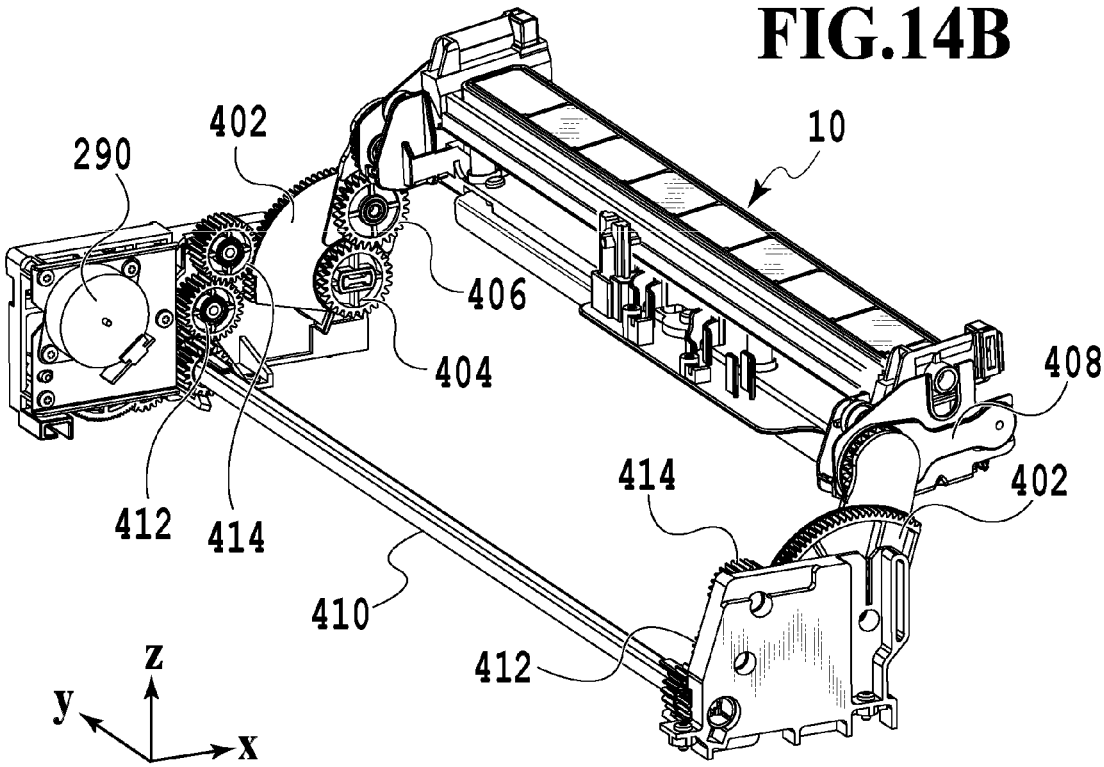

FIG. 13B is a view as seen along arrow XIIIB in FIG. 9C. FIG. 14A is a view showing the cap unit 10 at the evacuation position while FIG. 14B is a view showing the cap unit 10 at the cap position. The cap unit 10, disposed in the lower layer along with the lock member 216 and so on, is configured to be movable by the fourth drive part 288 to the evacuation position and the cap position by rotating while maintaining its posture. The movement path for the cap unit 10 to the evacuation position and the cap position partially overlaps the movement path for the wiping unit 17, located in the middle layer, to the evacuation position and the wiping start position.

The cap unit 10 (cap unit) is connected to the suction pump 218 through one of the tubes 215 (flow path). Note that these tubes 215 are attached to the valve unit 220 (valve unit). Also, the cap unit 10 is provided downstream in the x-direction of the wiping unit 17 at the evacuation position in the maintenance unit 16. The cap position (capping position) of the cap unit 10 is a position at which the ejection opening surface 8*a* can be capped by the cap member 10*a* by moving the print head 8 vertically downward. On the other hand, the evacuation position (uncapping position) of the cap unit 10 is a position outside the movement path for the wiping unit 17, i.e., a position at which the cap unit 10 does not interfere with movement of the wiping unit 17 between the evacuation position and the wiping start position. The cap unit 10 is located at the cap position in the case where the maintenance unit 16 is in the standby position, as shown in FIG. 8A. The cap unit 10 is located at the evacuation position in the case where the maintenance unit 16 is in the maintenance position, as shown in FIG. 8B. In the present embodiment, the wiping unit 10 is housed in the maintenance unit 16 in the case where the cap unit 10 is at the evacuation position.

As shown in FIGS. 13B, 14A, and 14B, the fourth drive part 288 includes a fourth motor 290, and rotating parts 401 that move the cap unit 10 with the fourth motor 290 while maintaining the posture of the cap unit 10. The rotating parts 401 are disposed at the opposite ends of the cap unit 10 in the y-direction. The rotating parts 401, disposed at the opposite ends, cooperate with each other to move the cap unit 10. Each rotating part 401 includes a gear train including a sector gear 402, a center gear 404, an idler gear 406, and a cap holder gear 408 (see FIG. 14B). The sector gear 402 and the center gear 404 have the same gear center. The sector gear 402 is held in a rotatable manner whereas the center gear 404 is fixed in a non-rotatable manner. The center gear 404 and the cap holder gear 408 have the same specification (the same number of teeth).

Note that the rotating parts 401 are provided symmetrically on the front side (the near side of FIGS. 14A and 14B) and the back side (the far side of FIGS. 14A and 14B) of the cap unit 10, and the two rotating parts 401 are both driven by the fourth motor 290. Drive force from the fourth motor 290 is transmitted to the rotating part 401 on the front side, disposed away from the fourth motor 290, through a drive shaft 410.

Thus, the drive force from the fourth motor 290 is transmitted to each sector gear 402 through idler gears 412 and 414, so that the sector gear 402 is rotated. The rotation of the sector gear 402 rotates the cap unit 10 about the rotation axis of the sector gear 402 and thereby moves the cap unit 10 to the cap position or the evacuation position (see FIGS. 14A and 14B). Here, since the center gear 404 and the cap holder gear 408 have the same specification (the same number of teeth), the cap unit 10 can be rotated while maintaining its posture (substantially horizontal state) regardless of the angle of rotation of the sector gear 402. In the present embodiment, forward rotation of the fourth motor 290 moves the cap unit 10 from the cap position to the evacuation position, whereas reverse rotation moves the cap unit 10 from the evacuation position to the cap position.

Figure 15A:
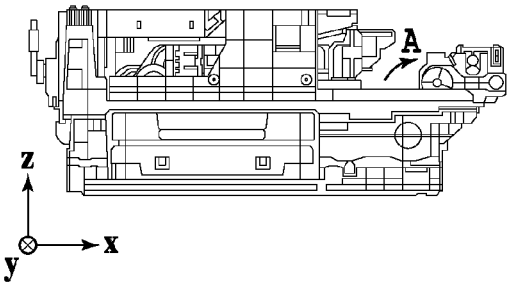
FIGS. 15A, 15B, 15C, 15D, 15E, and 15F are views showing the positions of the cap unit and the wiping unit during operation.
Figure 15B:
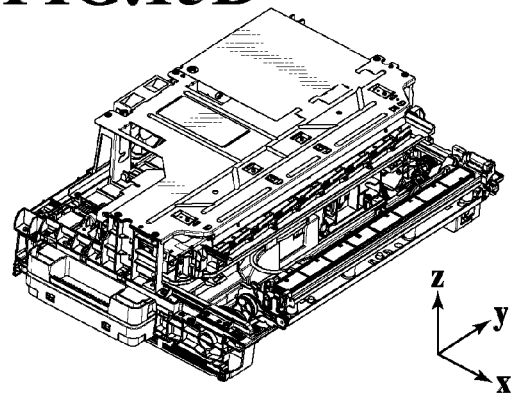
Figure 15C:
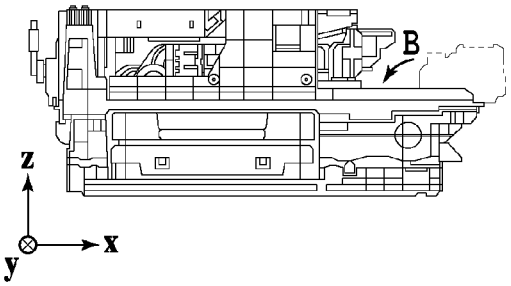
Figure 15D:
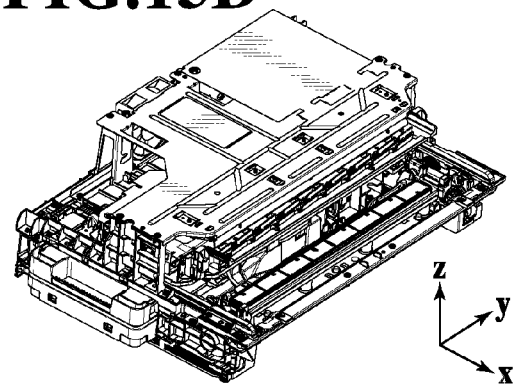

A description will be given of the capping and uncapping of the ejection opening surface 8*a* of the print head 8 by the maintenance unit 16 in the above configuration. FIG. 15A is a side view of the maintenance unit with the cap unit 10 at the cap position. FIG. 15B is a perspective view of the maintenance unit with the cap unit 10 at the cap position. FIG. 15C is a side view of the maintenance unit with the cap unit 10 at the evacuation position. FIG. 15D is a perspective view of the maintenance unit with the cap unit 10 at the evacuation position.

To cap the ejection opening surface 8*a*, the print controller 202 moves the print head 8 vertically upward by using the head carriage control unit 208. In doing so, the print controller 202 moves the print head 8 while rotating the print head 8 by 45 degrees in a case where the print head 8 is at the printing position. On the other hand, the print controller 202 moves the print head 8 with no rotation in a case where the print head 8 is at the maintenance position. Then, the print controller 202 moves the cap unit 10 at the evacuation position to the cap position (see arrow A in FIG. 15A) by using the maintenance control unit 210 (see FIGS. 15A and 15B). Thereafter, the print controller 202 moves the print head 8 vertically downward by using the head carriage control unit 208 to bring the ejection opening surface 8*a* into pressure contact with the cap member 10*a*. As a result, the ejection opening surface 8*a* is capped by the cap unit 10.

To uncap the ejection opening surface 8*a*, the print controller 202 moves the print head 8 vertically upward by using the head carriage control unit 208. Then, the print controller 202 moves the cap unit 10 at the cap position to the evacuation position (see arrow B in FIG. 15C) by using the maintenance control unit 210 (see FIGS. 15C and 15D). Then, in a case of performing printing with the print head 8, the print controller 202 rotates the print head 8 by 45 degrees while adjusting its height level in the vertical direction to make the ejection opening surface 8*a* face the platen 9 and moves the print head 8 to the printing position by using the head carriage control unit 208.

During the movement of the cap unit 10 between the evacuation position and the cap position, the wiping unit 17 is located at the evacuation position, at which it does not interfere with the movement of the cap unit 10. At this moment, the wiping unit 17 is locked by the lock member 216, so that its movement is restricted. Hence, the wiping unit 17 will not be moved from the evacuation position by shaking of the printing apparatus 1, application of an impact to the printing apparatus 1, or tilting of the printing apparatus 1 while the printing apparatus 1 is on standby, transported, or in other situations.

Figure 15E:
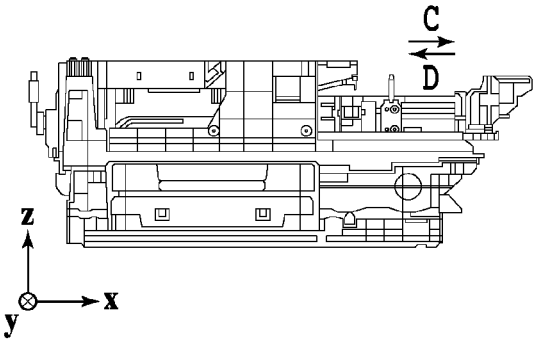
Figure 15F:
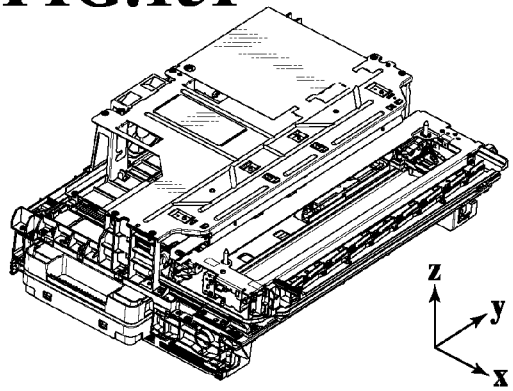

Next, a description will be given of the wiping of the ejection opening surface 8*a* of the print head 8 by the maintenance unit 16. FIG. 15E is a side view of the maintenance unit 16 with the wiping unit 17 at the wiping start position. FIG. 15F is a perspective view of the maintenance unit 16 with the wiping unit 17 at the wiping start position.

The print controller 202 moves the print head 8 vertically upward by using the head carriage control unit 208. In doing so, the print controller 202 moves the print head 8 while rotating the print head 8 by 45 degrees in the case where the print head 8 is at the printing position. On the other hand, in a case where the print head 8 is at the standby position, the print controller 202 moves the print head 8 while maintaining its posture as is. Then, the print controller 202 unlocks the wiping unit 17 by using the maintenance control unit 210. Specifically, the print controller 202 lowers the lock member 216 to release the restriction on movement of the wiping unit 17 at the evacuation position. Then, the print controller 202 moves the wiping unit 17 from the evacuation position to the wiping start position (see arrow C in FIG. 15E) by using the maintenance control unit 210 (see FIGS. 15E and 15F).

Further, the print controller 202 moves the print head 8 vertically downward by using the head carriage control unit 208 to place the print head 8 at the maintenance position, at which the wiping by the blade wipers 171*a* can be performed. Then, the print controller 202 moves the wiping unit 17 from the wiping start position to the evacuation position (see arrow D in FIG. 15E) by using the maintenance control unit 210 to wipe the ejection opening surface 8*a* with the blade wipers 171*a*. Note that during the movement of the wiping unit 17 between the evacuation position and the wiping start position, the cap unit 10 is located at the evacuation position, at which it does not interfere with the movement of the wiping unit 17.

As described above, in the maintenance unit 16 of the printing apparatus 1 for maintaining and restoring the ink ejection performance of the print head 8, the cap unit 10 is disposed in the layer below the layer in which the wiping unit 17 is disposed. Moreover, the range of movement of the wiping unit 17, which is slidable in the x-direction, and the range of movement of the cap unit 10, which is movable in the z-direction with a rotating motion, partially overlap each other. Accordingly, the size of the apparatus is reduced in the x-direction.

Also, the suction pump 218, the valve unit 220, and the cartridge 224 are disposed in the layer in which the cap unit 10 is provided. Hence, the space below the wiping unit 17 is utilized efficiently. Accordingly, the size of the maintenance unit 16 is reduced.

Here, the wiping unit 17, provided in the maintenance unit 16, is relatively heavy since the first drive part 212, the second drive part 240, the vacuum wiper unit 172, and so on are disposed in the wiping unit 17. For this reason, without being locked by the lock member 216, the wiping unit 17 may possibly be moved from the evacuation position by application of an impact to or tilting of the printing apparatus 1 while the printing apparatus 1 is on standby, transported, or in other situations. In this case, the wiping unit 17 may possibly contact and break other constituent members such as the print head 8.

In the printing apparatus 1, movement of the wiping unit 17 is restricted by locking the wiping unit 17 with the lock member 216 in the state where the wiping unit 17 is located at the evacuation position inside the maintenance unit 16. Hence, the wiping unit 17 remains inside the maintenance unit 16 even in a case where an impact is applied to the printing apparatus 1 or the printing apparatus 1 is tilted while it is transported or on standby. This prevents the wiping unit 17 from damaging other constituent members.

Also, the lock member 216 is driven by the third drive part 222, which is the same drive unit for the suction pump 218 and the valve unit 220, disposed in the same layer. In short, the lock member 216 is driven in conjunction with the suction pump 218 and the valve unit 220. Accordingly, the size of the apparatus is smaller than that in a case where each member is driven by a different drive part.

Other Embodiments

Note that the above embodiment may be modified as described in (1) to (4) below.

(1) In the above embodiment, a printing apparatus has been exemplarily described as the liquid ejection apparatus. However, the invention of the present application only needs to be such that the maintenance unit 16 is capable of wiping and capping an ejection opening surface from which a liquid is ejected, and is widely applicable to liquid ejection apparatuses including a liquid ejection head that ejects a liquid other than ink.

(2) In the above embodiment, the vacuum wiper 172*c* is disposed on the carriage 172*b* in the vacuum wiper unit 172, but the configuration is not limited to this. Specifically, the vacuum wiper unit 172 may include detection sensors (detection units) that detect the ejection state of the respective ejection openings in the ejection opening surface 8*a* in addition to the vacuum wiper 172*c*. Note that only the detection sensors may be disposed on the carriage 172*b* in place of the vacuum wiper 172*c*.

(3) In the above embodiment, the lock member 216 is driven by the third drive part 222, which is the same drive unit for the suction pump 218 and the valve unit 220, but the configuration is not limited to this. Specifically, the lock member 216 may be driven by the same drive unit for one of the suction pump 218 and the valve unit 220 or driven by a different drive unit from that for the suction pump 218 and the valve unit 220.

(4) In the above embodiment, the maintenance unit 16 includes the wiping unit 17 and the cap unit 10, but the configuration is not limited to this. Specifically, the maintenance unit 16 may include only the wiping unit 17.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-151443 filed Aug. 10, 2018, which is hereby incorporated by reference wherein in its entirety.

What is claimed is:

1. A liquid ejection apparatus comprising:

a liquid ejection head having an ejection opening surface in which an ejection opening for ejecting a liquid is arranged;

a cap unit configured to cap the ejection opening surface, the cap unit being movable between a capping position in which the cap unit caps the ejection opening surface and an uncapping position in which the cap unit does not cap the ejection opening surface;

a wiping unit configured to wipe the ejection opening surface, the wiping unit being movable to a first position in which the wiping unit is capable of wiping the ejection opening surface and to a second position in which the wiping unit is not capable of wiping the ejection opening surface; and a lock member configured lock the wiping unit at the second position, wherein the cap unit is movable between the capping position and the uncapping position in a state in which the wiping unit is in the second position, and wherein a range of movement of the wiping unit between the first position and the second position partially overlaps a range of movement of the cap unit between the capping position and the uncapping position.

2. The liquid ejection apparatus according to claim 1, wherein the lock member is movable to a locked position in which the lock member locks the wiping unit in the second position and to a unlocked position in which the lock member does not lock the wiping unit in the second position.

3. The liquid ejection apparatus according to claim 2, wherein the lock member is capable of being inserted into and pulled out from a hole formed in the wiping unit, wherein, in the locked position, the lock member locks the movement of the wiping unit by being inserted into the hole, and wherein, in the unlocked position, the lock member allows movement of the wiping unit by being pulled out from the hole.

4. The liquid ejection apparatus according to claim 1, wherein the cap unit moves between the capping position and the uncapping position by rotating.

5. The liquid ejection apparatus according to claim 1, further comprising a suction unit connected to the cap unit and configured to apply negative pressure to the cap unit, the suction unit being driven by a drive unit which drives the lock member.

6. The liquid ejection apparatus according to claim 5, wherein the lock member locks the wiping unit at the second position when the drive unit is driven in a first direction, the first direction being a direction in which the drive unit drives the suction unit, and wherein the lock member allows movement of the wiping member when the drive unit is driven in a second direction, the second direction being a direction in which the drive unit does not drive the suction unit.

7. The liquid ejection apparatus according to claim 5, further comprising:

a flow path connecting the cap unit and the suction unit;

a valve unit configured to open and close the flow path; and a storage member configured to store the liquid collected through the flow path, wherein the lock member, the suction unit, the valve unit, and the storage member are disposed below the wiping unit in a direction of gravity.

8. The liquid ejection apparatus according to claim 5, wherein the liquid ejection head has a plurality of the ejection openings on the ejection opening surface, the plurality of the ejection openings being arrayed in an area corresponding to a width of a print medium, and wherein the wiping unit includes:

a blade wiper configured to wipe the ejection opening surface with movement of the wiping unit from the first position to the second position, and a vacuum wiper configured to wipe the ejection opening surface and suck the liquid from the plurality of the ejection openings while moving in a direction crossing a direction from the first position toward the second position.

9. The liquid ejection apparatus according to claim 1, further comprising an applying unit configured to apply a process liquid to the wiping unit.

10. A maintenance apparatus comprising:

a cap unit configured to cap an ejection opening surface of a liquid ejection head, the cap unit being movable between a capping position in which the cap unit is capable of capping the ejection opening surface and an uncapping position in which the cap unit is not capable of capping the ejection opening surface, the ejection opening surface being a surface in which an ejection opening for ejecting a liquid is arranged;

a wiping unit configured to wipe the ejection opening surface, the wiping unit being movable to a first position in which the wiping unit is capable of wiping the ejection opening surface and to a second position in which the wiping unit is not capable of wiping the ejection opening surface; and a lock member configured lock the wiping unit at the second position, wherein the cap unit is movable between the capping position and the uncapping position in a state in which the wiping unit is in the second position, and wherein a range of movement of the wiping unit between the first position and the second position partially overlaps a range of movement of the cap unit between the capping position and the uncapping position.

11. The maintenance apparatus according to claim 10, wherein the lock member is movable to a locked position in which the lock member locks the wiping unit in the second position and to a unlocked position in which the lock member does not lock the wiping unit in the second position.

12. The maintenance apparatus according to claim 11, wherein the lock member is capable of being inserted into and pulled out from a hole formed in the wiping unit, wherein, in the locked position, the lock member locks the movement of the wiping unit by being inserted into the hole, and wherein, in the unlocked position, the lock member allows movement of the wiping unit by being pulled out from the hole.

13. The maintenance apparatus according to claim 10, wherein the cap unit moves between the capping position and the uncapping position by rotating.

14. The maintenance apparatus according to claim 10, further comprising a suction unit connected to the cap unit and configured to apply negative pressure to the cap unit, the suction unit being driven by a drive unit which drives the lock member.

15. The maintenance apparatus according to claim 14, wherein the lock member locks the wiping unit at the second position when the drive unit is driven in a first direction, the first direction being a direction in which the drive unit drives the suction unit, and wherein the lock member allows movement of the wiping member when the drive unit is driven in a second direction, the second direction being a direction in which the drive unit does not drive the suction unit.

16. The maintenance apparatus according to claim 14, further comprising:

a flow path connecting the cap unit and the suction unit;

a valve unit configured to open and close the flow path; and a storage member configured to store the liquid collected through a flow path, wherein the lock member, the suction unit, the valve unit, and the storage member are disposed below the wiping unit in a direction of gravity.

17. The maintenance apparatus according to claim 14, wherein the ejection opening surface includes a plurality of the ejection openings on the ejection opening surface, the plurality of the ejection openings being arrayed in an area corresponding to a width of a print medium, and wherein the wiping unit includes:

a blade wiper configured to wipe the ejection opening surface with movement of the wiping unit from the first position to the second position, and a vacuum wiper configured to wipe the ejection opening surface and suck the liquid from the plurality of the ejection openings while moving in a direction crossing a direction from the first position toward the second position.

18. The maintenance apparatus according to claim 10, further comprising an applying unit configured to apply a process liquid to the wiping unit.

* * * * *